US005677115A

United States Patent [19]

Goto

[11] Patent Number: 5,677,115

[45] Date of Patent: Oct. 14, 1997

[54] METHOD FOR PROCESSING SILVER HALIDE COLOR PHOTOGRAPHIC MATERIAL

[75] Inventor: Masatoshi Goto, Kanagawa, Japan

[73] Assignee: Fuji Photo Film Co., Ltd., Kanagawa, Japan

[21] Appl. No.: 689,008

[22] Filed: Jul. 30, 1996

Related U.S. Application Data

[63] Continuation of Ser. No. 358,596, Dec. 14, 1994, abandoned.

[30] Foreign Application Priority Data

Dec. 14, 1993 [JP] Japan ..... 5-342139

[51] Int. Cl.[6] ..... G03C 7/42

[52] U.S. Cl. ..... 430/393; 430/455; 430/460; 430/559; 430/570

[58] Field of Search ..... 430/393, 455, 430/457, 459, 460, 559, 570

[56] References Cited

U.S. PATENT DOCUMENTS

| | | | |
|---|---|---|---|
| 5,002,860 | 3/1991 | Ishikawa et al. | 430/393 |
| 5,004,677 | 4/1991 | Ueda | 430/393 |
| 5,011,763 | 4/1991 | Morimoto et al. | 430/393 |
| 5,093,228 | 3/1992 | Nakamura | 430/393 |
| 5,114,835 | 5/1992 | Sakanone | 430/393 |
| 5,217,855 | 6/1993 | Okada et al. | 430/393 |
| 5,223,379 | 6/1993 | Okada et al. | 430/393 |
| 5,250,401 | 10/1993 | Okada et al. | 430/393 |
| 5,250,402 | 10/1993 | Okada et al. | 430/393 |
| 5,275,923 | 1/1994 | Fyson | 430/455 |
| 5,314,791 | 5/1994 | Ishikawa et al. | 430/455 |
| 5,389,501 | 2/1995 | Rogers et al. | 430/393 |

*Primary Examiner*—Hoa Van Le

*Attorney, Agent, or Firm*—Sughrue, Mion, Zinn, Macpeak & Seas, PLLC

[57] ABSTRACT

A silver halide color photographic material having at least one silver halide emulsion layer on a support is color developed after imagewise exposure, followed by desilverization, wherein the photographic material has a total dry film thickness of 8 to 22 μm, the concentration of ammonium ions contained in a processing solution having fixing ability used in desilverization is 0 to 50 mol % based on the total cations, and the processing solution having fixing ability contains at least one kind of thioether compound, thereby improving desilverization performance in continuous processing and preventing yellow stains from increasing.

14 Claims, No Drawings

METHOD FOR PROCESSING SILVER HALIDE COLOR PHOTOGRAPHIC MATERIAL

This is a continuation of application Ser. No. 08/358,596 filed Dec. 14, 1994, now abandoned.

FIELD OF THE INVENTION

The present invention relates to a method for processing a silver halide color photographic material (hereinafter also briefly referred to as a photographic material).

BACKGROUND OF THE INVENTION

In general, basic stages for processing silver halide color photographic materials comprise a color developing stage and a desilvering stage. In the color developing stage, exposed silver halides are reduced with color developing agents to produce silver, and the oxidized color developing agents react with color formers (couplers) to give dye images. The usual silver halide color photographic materials are subjected to the color developing stage after imagewise exposure. However, silver halide color reversal photographic materials are subjected to black-and-white development and a reversal processing stage after imagewise exposure, and thereafter to the color developing stage. In the subsequent desilvering stage, silver produced in the color developing stage is oxidized by an action of oxidizing agents conventionally called as bleaching agents, and then, dissolved with agents for forming complex silver ions conventionally called as fixing agents. By the process in the desilvering stage, only the dye images are formed in the color photographic materials. The desilvering stage generally comprises bleaching stage and fixing stage as described above. In some cases where bleaching and fixing are conducted in one bath (bleach-fixing), bleach-fixing is conducted after bleaching, or between bleaching and fixing.

The photographic materials in which the dye images are formed are processed with stabilizing solutions after desilvering for improving in keeping quality of the resulting dye images. The processing with the stabilizing solutions is conducted after a washing stage or directly after desilvering stage. In the process of the color reversal photographic materials, there is known a method in which an image stabilizer is added to a compensating solution instead of using the stabilizing solution as a final bath, thereby stabilizing dye images.

Recently, it has been desired to reduce an amount of ammonium ions contained in processing solutions, from the viewpoint of the social environment. In particular, since processing solutions having fixing ability such as bleach-fixing solutions and fixing solutions contain ammonium ions in large amounts, it has been desired to reduce the amount of ammonium ions contained in these solutions.

However, the process with the processing solutions having fixing ability in which the amount of ammonium ions is reduced is suffered from problem of delayed desilverization. As a technique for solving the problem, a method for processing photographic materials with fixing solutions containing thioether compounds is proposed in European Patent 569008.

However, the above-described method provides insufficient desilvering performance in continuous process, and further has a problem for generating yellow stains with a laspe of time when the processed photographic materials are stored.

SUMMARY OF THE INVENTION

A first object of the present invention is to provide a method for processing a silver halide color photographic material excellent in desilvering performance, particularly in continuous processing with a processing solution having fixing ability in which an amount of ammonium ions is reduced.

A second object of the present invention is to provide a method for processing a silver halide color photographic material in which generation of yellow stains with time is reduced.

According to the present invention, there is to provide a method for processing a silver halide color photographic material comprising color developing the silver halide color photographic material having at least one silver halide emulsion layer on a support after imagewise exposure, and then desilvering thereof, wherein said photographic material has a total thickness of dry film in 8 to 22 μm, a concentration of ammonium ions contained in a processing solution having fixing ability used in desilverization is 0 to 50 mol % based on the total cations, and said processing solution having fixing ability contains at least one kind of thioether compound.

DETAILED DESCRIPTION OF THE INVENTION

When a replenishment rate of the processing solutions having fixing ability is small in continuously processing for photographic materials by replenishing solutions with replenishers, an effect of the present invention is attained particularly significant. The present inventors presume that a reason is that components eluted from the processed photographic materials are accumulated in the processing solutions having fixing ability, which results in delaying desilverization and increasing yellow stains.

In the present invention, the replenishment rate of the processing solutions having fixing ability can be 20 to 1500 ml per square meter of photographic material, preferably 25 to 1000 ml, more preferably 30 to 800 ml, and the most preferably 100 to 500 ml.

The replenishment rate of the processing solutions having fixing ability used herein means a total amount of solutions replenished to the processing solutions having fixing ability with which the photographic materials are processed. Accordingly, when overflowed solutions from washing water, etc. are also introduced, in addition to the replenishers having fixing ability, the replenishment rate include an amount of these solutions.

The imagewise-exposed silver halide color photographic materials of the present invention are subjected to desilvering after color development. Desilveriztion may be conducted immediately after color development without other processing stages, or may be conducted after processing stages such as terminating, compensating and washing, after color development, in order to prevent unnecessary post-development and aerial fog and reduce color developing solutions carried over, the desilvering stage, or in order to wash out and components such as sensitizing dyes and dyestuffs contained in the photographic materials to color developing agents impregnated in the photographic materials to make them harmless.

In desilvering process, the photographic materials are basically bleached with processing solutions having bleaching ability, followed by fixing with the processing solutions having fixing ability. Bleaching and fixing may be carried out individually in this manner, or may be conducted concurrently with bleach-fixing solutions having both fixing and bleaching ability (bleach-fixing). Each of the bleaching, fixing and bleach-fixing may be carried out in one tank or in two or more tanks.

In the present invention, a term processing solution having bleaching ability refers to a processing solution containing a bleaching agent amoung the processing solutions used in the desilvering stage, specifically a bleaching solution and a bleach-fixing solution. Further, a term processing solution having fixing ability refers to a processing solution containing a fixing agent amoung the processing solutions used in the desilvering stage, specifically a fixing solution and a bleach-fixing solution.

According to the present invention, the processing solution having bleaching ability is preferably bleaching solution, and the processing solution having fixing ability is preferably fixing solution.

Specific embodiments of the desilvering stage used in the present invention are shown below, but they are not limited thereto.

1. Bleaching—Fixing
2. Bleach-fixing
3. Bleaching—Bleach-fixing
4. Bleach-fixing—Bleach-fixing
5. Bleaching—Bleach-fixing—Fixing
6. Bleaching—Bleach-fixing—Bleach-fixing
7. Bleaching—Fixing—Fixing
8. Bleaching—Fixing—Bleach-fixing
9. Bleach-fixing—Fixing
10. Bleach-fixing—Bleaching A washing stage may be arbitrarily provided between these processing stages.

In the present invention, a term thioether compound refers to a compound having a thioether linkage in its molecule.

Preferred thioether compounds are represented by following formula (FA):

$$L_a—(A—L_b)_n—B—L_c \quad \text{(FA)}$$

wherein $L_a$ and $L_c$, which may be the same or different, each represents an alkyl group, an aryl group, an aralkyl group, an alkenyl group or a heterocyclic group; $L_a$ and $L_c$ may combine each other to form a ring structure; $L_b$ represents an alkylene group, an arylene group, an aralkylene group or a heterocyclic linkage group; n represents 0 or an integer of 1 to 4; when n is an integer of 2 to 4, $(A—L_b)$ may be the same or different; A and B, which may be the same or different, each represents —S—, —O—, —N($R_a$)—, —C(=O)—, —C(=S)—, —S(=O)$_2$— or a combination thereof, with the proviso that at least one of A and B represents —S—; and $R_a$ represents a hydrogen atom, an alkyl group, an aryl group, an aralkyl group or an alkenyl group.

Formula (FA) is described below in detail.

$L_a$ and $L_b$, which may be the same or different, each represents a substituted or unsubstituted alkyl group having 1 to 10 carbon atoms (for example, methyl, ethyl, propyl, hexyl, isopropyl or carboxyethyl), a substituted or unsubstituted aryl group having 6 to 12 carbon atoms (for example, phenyl, 4-methylphenyl or 3-methoxyphenyl), a substituted or unsubstituted aralkyl group having 7 to 12 carbon atoms (for example, benzyl or phenethyl), a substituted or unsubstituted alkenyl group having 2 to 10 carbon atoms (for example, vinyl, propenyl or 1-methylvinyl), or a substituted or unsubstituted heterocyclic group having 1 to 10 carbon atoms (for example, pyridyl, furyl, thienyl or imidazolyl). $L_a$ and $L_c$ may combine each other to form a ring structure.

$L_b$ represents a substituted or unsubstituted alkylene group having 1 to 10 carbon atoms (for example, methylene, ethylene, trimethylene, tetramethylene, pentamethylene, hexamethylene, 1-methylethylene or 1-hydroxytrimethylene), a substituted or unsubstituted arylene group having 6 to 12 carbon atoms (for example, phenylene or naphthylene), a substituted or unsubstituted aralkylene group having 7 to 12 carbon atoms (for example, 1,2-xylylene), or a substituted or unsubstituted heterocyclic linkage group having 1 to 10 carbon atoms (for example,

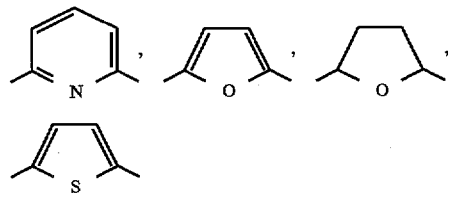

or a combination thereof (to form, for example,

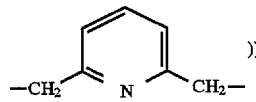

)).

Examples of the combination of A and B include —C(=O)—N($R_a$)—, —N($R_a$)—C(=O)—, —N($R_a$)—C(=O)—N($R_a$')—, —C(=0)—O—, —O—C(=O)—, —S(=O)$_2$—N($R_a$)—, —N($R_a$)SO$_2$—, —C(=S)—N($R_a$)—, —N($R_a$)—C(=S)— and —N($R_a$)—C(=S)—N($R_a$')—, wherein $R_a$' has the same meaning as that of $R_a$.

$R_a$ and $R_a$' each represents a hydrogen atom, a substituted or unsubstituted alkyl group having 1 to 10 carbon atoms (for example, methyl, ethyl, propyl, hexyl or isopropyl), a substituted or unsubstituted aryl group having 6 to 12 carbon atoms (for example, phenyl, 4-methylphenyl or 3-methoxyphenyl), a substituted or unsubstituted aralkyl group having 7 to 12 carbon atoms (for example, benzyl or phenethyl), or a substituted or unsubstituted alkenyl group having 2 to 10 carbon atoms (for example, vinyl, propenyl or 1-methylvinyl).

When $L_a$, $L_b$, $L_c$, $R_a$ and $R_a$' have substituent groups, the substituent groups include lower alkyl groups having 1 to 4 carbon atoms (for example, methyl and ethyl), aryl groups having 6 to 10 carbon atoms (for example, phenyl and 4-methylphenyl), aralkyl groups having 7 to 10 carbon atoms (for example, benzyl), alkenyl groups having 2 to 4 carbon atoms (for example, propenyl), alkoxyl groups having 1 to 4 carbon atoms (for example, methoxy and ethoxy), halogen atoms (for example, chlorine and bromine), a cyano group, a nitro group, carboxyl groups (which may be in a salt form), a hydroxyl group, amino groups (which include unsubstituted amino and methyl amino, and may be in a form of salts such as hydrochlorides and acetates), sulfamoyl groups (for example, dimethylsulfamoyl), sulfonamido groups (for example, methanesulfonamido), a sulfo group, carbamoyl groups (for example, N-methylcarbamoyl), a formamido group, alkylamido groups (for example, acetamido), sulfonyl groups (for example, methanesulfonyl), phosphonamido groups (for example, tetramethylphosphonamido), ureido groups (for example, N,N-dimethylureido) and heterocyclic groups (for example, pyridyl, imidazolyl, thienyl and tetrahydrofuranyl).

In the present invention, each of A and B is preferably —S—, and $L_a$ is preferably an alkyl group substituted by hydroxyl, carboxyl, amino, carbamoyl, sulfamoyl or sulfo group. $L_b$ is preferably an alkylene group. $L_c$ is preferably an alkyl group, and more preferably an alkyl group substituted by hydroxyl, carboxyl, amino, carbamoyl, sulfamoyl or sulfo group.

Examples of the thioether compounds used in the present invention are enumerated below, but the compounds used in the present invention is not limited thereto.

FA-1: $CH_2SCH_2CH_2OH$
FA-2: $HOCH_2CH_2SCH_2CH_2OH$
FA-3: $HOCH_2CH_2SCH_2CH_2SCH_2CH_2OH$
FA-4: $HOCH_2CH_2SCH_2CH_2SCH_2CH_2SCH_2CH_2OH$
FA-5: $HOCH_2CH_2SCH_2CH_2OCH_2CH_2OCH_2CH_2SCH_2CH_2OH$
FA-6: $HOCH_2CH_2OCH_2CH_2SCH_2CH_2SCH_2CH_2OCH_2CH_2OH$
FA-7: $CH_3SCH_2CH_2COOH$
FA-8: $HOOCCH_2SCH_2COOH$
FA-9: $HOOCCH_2CH_2SCH_2CH_2COOH$
FA-10: $HOOCCH_2SCH_2CH_2SCH_2COOH$
FA-11: $HOOCCH_2SCH_2CH_2SCH_2CH_2SCH_2CH_2SCH_2COOH$
FA-12: $HOOCCH_2CH_2SCH_2CH_2SCH_2CH(OH)CH_2SCH_2CH_2SCH_2CH_2COOH$
FA-13: $HOOCCH_2CH_2SCH_2CH_2SCH_2CH(OH)CH(OH)CH_2SCH_2CH_2SCH_2CH_2COOH$
FA-14: $CH_3SCH_2CH_2CH_2NH_2$
FA-15: $H_2NCH_2CH_2SCH_2CH_2NH_2$
FA-16: $H_2NCH_2CH_2SCH_2CH_2SCH_2CH_2NH_2$
FA-17: $CH_3SCH_2CH_2CH(NH_2)COOH$
FA-18: $H_2NCH_2CH_2OCH_2CH_2SCH_2CH_2SCH_2CH_2OCH_2CH_2NH_2$
FA-19: $H_2NCH_2CH_2SCH_2CH_2OCH_2CH_2OCH_2CH_2SCH_2CH_2NH_2$
FA-20: $H_2NCH_2CH_2SCH_2CH_2SCH_2CH_2SCH_2CH_2SCH_2CH_2NH_2$
FA-21: $HOOC(NH_2)CHCH_2CH_2SCH_2CH_2SCH_2CH_2CH(NH_2)COOH$
FA-22: $HOOC(NH_2)CHCH_2SCH_2CH_2OCH_2CH_2OCH_2CH_2SCH_2CH(NH_2)COOH$
FA-23: $HOOC(NH_2)CHCH_2OCH_2CH_2SCH_2CH_2SCH_2CH_2OCH_2CH(NH_2)COOH$
FA-24: $H_2N(O=)CCH_2SCH_2CH_2OCH_2CH_2OCH_2CH_2SCH_2C(=O)NH_2$
FA-25: $H_2N(O=)CCH_2SCH_2CH_2SCH_2C(=O)NH_2$
FA-26: $H_2NHN(O=)CCH_2SCH_2CH_2SCH_2C(=O)NH_2$
FA-27: $CH_3C(=O)NHCH_2CH_2SCH_2CH_2SCH_2CH_2NHC(=O)CH_3$
FA-28: $H_2NO_2SCH_2CH_2SCH_2CH_2SCH_2CH_2SO_2NH_2$
FA-29: $NaO_3SCH_2CH_2CH_2SCH_2CH_2SCH_2CH_2CH_2SO_3Na$
FA-30: $CH_3SO_2NHCH_2CH_2SCH_2CH_2SCH_2CH_2NHO_2SCH_3$
FA-31: $H_2N(NH)CSCH_2CH_2SC(NH)NH_2.2HBr$
FA-32: $H_2N(NH)CSCH_2CH_2OCH_2CH_2OCH_2CH_2SC(NH)NH_2.2HCl$
FA-33: $H_2N(NH)CNHCH_2CH_2SCH_2CH_2SCH_2CH_2NHC(NH)NH_2.2HBr$
FA-34: $[(CH_3)_3NCH_2CH_2SCH_2CH_2SCH_2CH_2N(CH_3)_3]^{2+}2Cl^-$

FA-35:

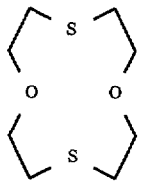

FA-36:

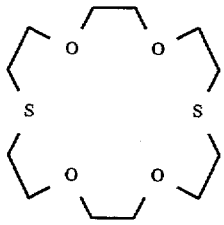

FA-37:

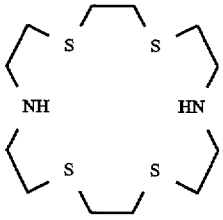

-continued

FA-38:

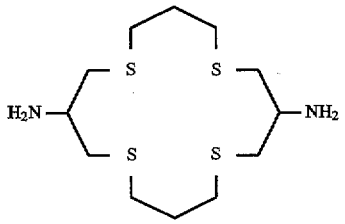

FA-39:

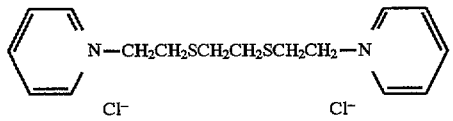

FA-40:

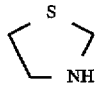

FA-41:

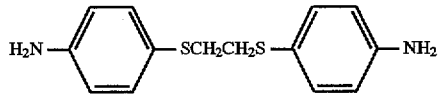

FA-42:

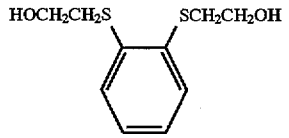

FA-43:

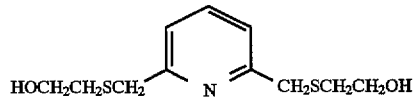

FA-44:

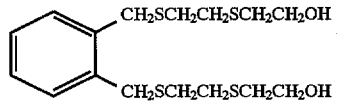

FA-45:

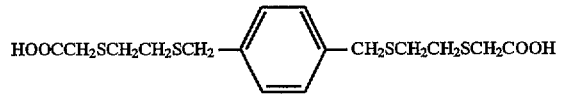

FA-46:

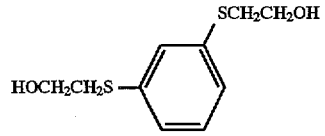

FA-47:

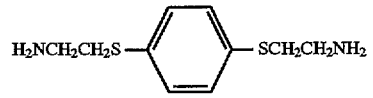

The compounds represented by formula (FA) can be easily synthesized with reference to *J. Org. Chem.*, 30, 2867 (1965), ibid., 27, 2846 (1962), *J. Am. Chem. Soc.*, .69, 2330 (1947), etc.

In the present invention, the above-described thioether compounds are added preferably in an amount of 0.0005 to 1.2 mol per liter of processing solution having fixing ability, more preferably in an amount of 0.005 to 1 mol per liter, further preferably in an amount of 0.01 to 0.5 mol per liter, and the most preferably in an amount of 0.01 to 0.1 mol per liter.

The concentration of ammonium ions contained in the processing solutions having fixing ability is 0 to 50 mol % based on the total cations, preferably 0 to 30 mol %, and more preferably 0 to 10 mol %. It is the most preferred that no ammonium ions are contained at all.

In order to attain the above-described concentration of the ammonium ions, alkaline metals are preferably used as the cation species. In particular, sodium ions and potassium ions are preferred.

The fixing agents contained in the fixing solutions (fixing solutions and bleach-fixing solutions) include thiosulfates such as sodium thiosulfate, ammonium thiosulfate, ammonium sodium thiosulfate and potassium thiosulfate; thiocyanates (rhodanides) such as sodium thiocyanate, ammonium thiocyanate and potassium thiocyanate; and thiourea.

When the thiosulfates are used alone as the fixing agents, they are added in an amount of about 0.3 to 3 mol per liter of processing solution having fixing ability, and preferably in an amount of about 0.5 to 2 mol per liter. When the thiocyanates are used alone, they are added in an amount of about 1 to 4 mol per liter of processing solution. In general, including the case where the fixing agents are used in combination, the amount of the fixing agents is 0.3 to 5 mol per liter of processing solution having fixing ability, and preferably 0.5 to 3.5 mol per liter. When the fixing agents are used in combination, a total amount thereof is adjusted within the range described above.

Compounds other than thiocyanates which can be used in combination with the thiosulfates include thiourea.

The processing solutions having fixing ability can contain sulfites (for example, sodium sulfite, potassium sulfite and ammonium sulfite), hydroxylamine, hydrazine and bisulfite addition compounds of acetaldehyde compounds (for example, acetaldehyde sodium bisulfite) as preservatives. Further, the processing solutions can also contain various fluorescent brightening agents, antifoaming agents, surfactants and organic solvents such as polyvinylpyrrolidone and methanol. It is particularly preferred that sulfinic acid compounds described in JP-A-60-283881 (the term "JP-A" as used therein means an "unexamined published Japanese patent application") are used as the preservatives.

In order to reduce yellow stains caused during storage of the processed photographic materials, a pH of the processing solutions having fixing ability ranges preferably from 4 to 9, more preferably from 4.3 to 7.5, further preferably from 4.5 to 6.5, and the most preferably from 4.5 to 6.0. Compounds having a pKa ranging from 4 to 9 are preferably contained as buffers to adjust the pH to within such a range. Preferred examples of such compounds include imidazoles such as imidazole and 2-methyl-imidazole, fatty monobasic acids such as acetic acid and glycolic acid, and fatty dibasic acids such as malonic acid, succinic acid, adipic acid and glutaric acid. These compounds are contained preferably in an amount of 0.05 to 10 mol per liter of processing solution having fixing ability, and more preferably in an amount of 0.1 to 3 mol per liter.

It is preferred that the fixing processing time is established to 15 seconds to 4 minutes in the present invention.

Known organic acids may be added to the processing solutions having fixing ability. Preferred examples of the organic acids include aminopolycarboxylic acids and organic phosphons described in JP-A-2-139548, chelating agents such as 1,3-diaminopropane tetraacetic acid, which are preferably added to fixing solutions, and acids having a pKa of 2.0 to 5.5 described for the bleaching agents in this specification.

These acids may be used either alone or in combination of two or more thereof.

The color developing solutions used in the present invention contain a aromatic primary amine color developing agent. These color developing agents are used preferably in an amount of 1 to 20 g per liter of color developing solution, and more preferably in an amount of 2 to 8 g per liter.

These color developing solutions may be used either alone or in combination of two or more thereof.

Examples of the color developing agents include but are not limited to the following compounds:

D-1 N,N-diethyl-p-phenylenediamine

D-2 2-Amino-5-diethylaminotoluene

D-3 2-Amino-5-(N-ethyl-N-laurylamino)toluene

D-4 4-[N-ethyl-N-(β-hydroxyethyl)amino]aniline

D-5 2-Methyl-4-[N-ethyl-N-(β-hydroxyethyl)amino]aniline

D-6 4-Amino-3-methyl-N-ethyl-N-[β-(methanesulfonamido)ethyl)aniline

D-7 N-(2-Amino-5-diethylaminophenylethyl) methanesulfon-amide

D-8 N,N-Dimethyl-p-phenylenediamine

D-9 4-Amino-3-methyl-N-ethyl-N-methoxyethylaniline

D-10 4-Amino-3-methyl-N-ethyl-N-β-ethoxyethylaniline

D-11 4-Amino-3-methyl-N-ethyl-N-β-butoxyethylaniline

In the present invention, D-4, D-5 and D-6 are preferably used as the color developing agents.

The color developing solutions may contain sulfites such as sodium sulfite, potassium sulfite, sodium bisulfite, potassium bisulfite, sodium metasulfite and potassium metasulfite, and sulfite addition compounds of carbonyl compounds as preservatives, if necessary. They are added preferably in an amount of 20 g or less per liter of color developing solution, more preferably in an amount of 10 g or less per liter, and most preferably in an amount of 0.05 to 5 g per liter.

In the present invention, hydroxylamine and hydroxylamine derivatives described in JP-A-2-64632 are preferably used as preservatives. Other know preservatives may be used in combination therewith. Such preservatives include hydroxamic acids described in JP-A-63-43138, hydrazines described in JP-A-63-170642, hydrazine derivatives described in JP-A-2-64632, phenols described in JP-A-63-44657 and JP-A-63-58443, α-hydroxyketones and α-aminoketones described in JP-A-63-44656, and various polysaccharides described in JP-A-63-36244. Further, the preservatives which may be used in combination with the above-described compounds include monoamines described in JP-A-63-4235, JP-A-63-24254, JP-A-63-21647, JP-A-63-146040, JP-A-63-27841 and JP-A-63-25654, diamines described in JP-A-63-30845, JP-A-63-146040 and JP-A-63-43439, polyamines described in JP-A-63-21647, JP-A-63-26655, and JP-A-63-44655, nitroxyl radicals described in JP-A-63-53551, alcohols described in JP-A-63-43140 and JP-A-63-53549, oximes described in JP-A-63-56654 and tertiary amines described in JP-A-63-239447.

As other preservatives, various metals described in JP-A-57-44148 and JP-A-57-53749, salicylic acid derivatives described in JP-A-59-180588, alkanolamines described in JP-A-54-3532, polyethyleneimines described in JP-A-56-94349 and aromatic polyhydroxy compounds described in U.S. Pat. No. 3,746,544 may be contained if necessary.

These compounds may be allowed to be contained in the photographic materials. Even when the compounds are contained in bleaching solutions, bleach-fixing solutions, washing solutions or stabilizing solutions substituted for washing solutions, the compounds can act on the color developing agents or oxides thereof existing in the respective solutions (caused by carrying over from the color developing solutions) to provide good performance.

The color developing solutions used in the present invention have preferably a pH of 9 to 12, and more preferably a pH of 9 to 11.0, and other known constituent compounds for developing solution can be added thereto.

In order to maintain the above-described pH, various buffers are preferably used. In particular, carbonates, phosphates, tetraborates and hydroxybenzoates are excellent in solubility and in buffering ability in the high pH region of 9.0 or more.

Examples of the buffers include sodium carbonate, potassium carbonate, sodiumbicarbonate, potassium bicarbonate, trisodium phosphate, tripotassium phosphate, dipotassium phosphate, sodiumborate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffers used in the present invention are not limited to these compounds.

The buffers are added to the color developing solutions preferably in an amount of at least 0.1 mol/l, and particularly preferably in an amount of 0.1 to 0.4 mol/l.

In addition, various chelating agents can be used in the color developing solutions as precipitation prohibiting agents for calcium or magnesium, or to improve the stability of the color developing solutions. The chelating agents are preferably organic acid compounds, which include, for example, aminopolycarboxylic acids, organic phosphonic acids and phosphonocarboxylic acids. Examples thereof include nitrilotriacetic acid, diethylenetriaminepentaacetic acid, ethylenediaminetetraacetic acid, N,N,N-trimethylenephosphonic acid, ethylenediamine-N,N,N',N'-tetramethylene-sulfonic acid, transcyclohexanediaminetetraacetic acid, 1,2-diaminopropanetetraacetic acid, hydroxyethyliminodiacetic acid, glycoletherdiaminetetraacetic acid, ethylenediamine-o-hydroxyphenylacetic acid, 1-phosphonobutane-1,2,4-tri-carboxylic acid, 1-hydroxyethylidene-1,1-diphosphonic acid, N,N'-bis(2-hydroxybenzyl)ethylenediamine-N,N'-diacetic acid and 1,2-dihydroxybenzene-3,5-diphosphonic acid. These chelating agents may be used as a combination of two or more thereof, if necessary.

Of the above-described compounds, the organic phosphonic acids and 1,2-dihydroxybenzene-3,5-diphosphonic acid are preferably added to the color developing solutions to prevent an increase in Dmin due to contamination of the color developing solutions with the bleaching agents in the present invention.

The chelating agents are added preferably in an amount of 0.01 to 20 g per liter of color developing solution, and more preferably in an amount of 0.1 to 10 g per liter.

Any development accelerators may be added to the color developing solutions as desired. However, it is preferred that the color developing solutions used in the present invention are substantially free from benzyl alcohol, from the viewpoints of chemical mixing and the prevention of color contamination. Here, the developing solutions "substantially" free from benzyl alcohol mean developing solutions containing benzyl alcohol at a concentration of 2 ml/l or less, and preferably containing no benzyl alcohol at all.

As other development accelerators, thioether compounds described in JP-B-37-16088 (the term "JP-B" as used herein means an "examined Japanese patent publication"), JP-B-37-5987, JP-B-38-7826, JP-B-44-12380, JP-B-45-9019, and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796, 3,253,919, 2,482,546, 2,596,926 and 3,582,346 and JP-B-41-11431; polyalkylene oxides described in JP-B-37-16088, JP-B-42-25201, U.S. Pat. No. 3,128,183, JP-B-41-11431, JP-B-42-23883 and U.S. Pat. No. 3,532,501; 1-phenyl-3-pyrazolidone compounds; and imidazole compounds can be added if necessary.

In the present invention, when the color reversal photographic materials are processed, black-and-white development is conducted prior to color development.

Conventional developing agents can be used as the black-and-white developing solutions used in the present invention. The developing agents include dihydroxybenzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid and heterocyclic compounds such as condensates of 1,2,3,4-tetrahydroquinoline rings and indolene rings described in U.S. Pat. No. 4,067,872. These developing agents may be used alone or in combination.

The black-and-white developing solutions used in the present invention may contain preservatives (for example, sulfites and bisulfites), buffers (for example, carbonates, boric acid, borates and alkanolamines), alkali agents (for example, hydroxides and carbonates), auxiliary solubilizing agents (for example, polyethylene glycols and esters thereof), pH adjusting agents (for example, organic acids such as acetic acid), sensitizers (for example, quaternary ammonium salts), development accelerators, surfactants, defoaming agents, hardening agents and viscosity imparting agents (tackifiers).

It is necessary that the black-and-white developing solutions used in the present invention contain compounds which act as solvents for silver halides. Usually, the sulfites added as the above-described preservatives are effectively served. Examples of the sulfites and other available solvents for silver halides include KSCN, NaSCN, $K_2SO_3$, $Na_2SO_3$, $K_2S_2O_5$, $Na_2S_2O_5$, $K_2S_2O_3$ and $Na_2S_2O_3$.

A pH value of the developing solutions thus adjusted is selected to control a degree enough to give a desired density and contrast, and is within the range of about 8.5 to about 11.5.

Sensitization using such black-and-white developing solutions usually requires only the prolongation of the processing time up to about 3 times a standard processing time. Under the circumstances, an increase in processing temperature can shorten the prolonged time for sensitization.

The replenishment rate of the black-and-white developing solutions is usually 3 liters or less per square meter of photographic material though it depends on color photographic materials to be processed. The replenishment rate can also be decreased to 500 ml or less per square meter by reducing the ion concentration of bromides contained in replenishers. When the replenishment rate is decreased, it is preferred to reduce the contact area of the processing solutions with air in a processing tank and a replenisher tank to prevent the solution from evaporation and air oxidation. The contact area of the photographic processing solutions with air in the processing tank and the replenisher tank can be represented by the opening ratio defined below.

Opening ratio=(Contact area of processing solution with air ($cm^2$))/(Volume of processing solution ($cm^3$))

The above-described opening ratio is preferably 0.1 or less, and more preferably 0.001 to 0.05.

Methods for reducing the opening ratio include the method of using a movable cover described in JP-A-1-82003 and the slit developing method described in JP-A-63-216050, in addition to a method in which shields such as floating covers are provided on the surfaces of photographic processing solutions in a processing tank and a replenisher tank. A reduction in opening ratio is preferably applied not only to both stages of color development and black-and-white development, but also to succeeding stages, for example, all stages of bleaching, bleach-fixing, fixing, washing, stabilizing stages and the like. The replenishment rate can also be decreased by depressing accumulation of bromide ions in the developing solution.

Reversal baths used in black-and-white development may contain known fogging agents. Such fogging agents include stannous ion complex salts such as stannous ion-organic phosphoric acid complex salts (U.S. Pat. No. 3,617,282), stannous ion-organic phosphonocarboxylic acid complex salts (JP-B-56-32616) and stannous ion-aminopolycarboxylic acid complex salts (British Patent 1,209,050), and boron compounds such as hydrogenated boron compounds (U.S. Pat. No. 2,984,567) and heterocyclic amine borane compounds (British Patent 1,011,000). The pH of the fogging bath (reversal bath), which widely ranges from the acidic side to the basic side, is 2 to 12, and preferably 2.5 to 10. The range of 3 to 9 is particularly preferred. Light reversal processing may be conducted by reexposure instead of a reversal bath treatment, and the reversal stage may be omitted by addition of the fogging agent to the color developing solution.

As the bleaching agents used in the solution having bleaching ability, for example, compounds of polyvalent metals such as ferric (III), peracids, quinones and nitro compounds are used. Typical examples of the bleaching agents include organic complex ferric (III) salts such as complex ferric (III) salts with ethylenediaminetetraacetic acid, diethylenetriaminepentaacetic acid, cyclohexanediaminetetraacetic acid, methyliminodiacetic acid and glycoletherdiamine- tetraacetic acid, bleaching agents including the iron complex salt with 1,3-propylenediaminetetraacetic acid described in JP-A-4-121739, page 4, lower right column to page 5, upper left cole, carbamoyl bleaching agents described in JP-A-4-73647, hetero ring-containing bleaching agents described in JP-A-4-174432, bleaching agents including the ferric complex salt with N-(2-carboxyphenyl)iminodiacetic acid described in European Patent Publication No. 520457, bleaching agents including the ferric complex salt with ethylenediamine-N-2-carboxyphenyl-N,N',N'-triacetic acid described in European Patent Publication No. 530828A1, bleaching agents described in European Patent Publication No. 501479, bleaching agents described in JP-A-5-303186, and ferric complex salts with aminopolycarboxylic acids or salts thereof described in JP-A-3-144446, page 11.

The complex ferric (III) salts of organic aminocarboxylic acids are particularly useful in both bleaching solutions and the bleach-fixing solutions. The pH of the bleaching solutions or the bleach-fixing solutions using these complex ferric (III) salts of organic aminocarboxylic acids is usually 4.0 to 8.0. However, the pH can also be further lowered to expedite processing rate.

In the present invention, the processing solutions having bleaching ability can contain rehalogenating agents described in JP-A-3-144446, page 12, pH buffers, known additives, aminopolycarboxylic acids and organic phosphonic acids, in addition to the bleaching agents.

Further, various bleaching promoters may be added to the bleaching solutions or the preceding baths. Examples of such bleaching promoters include compounds having mercapto groups or disulfide linkages described in U.S. Pat. No. 3,893,858, West German Patent 1,290,812, British Patent 1,138,842, JP-A-53-95630 and *Research Disclosure* No. 17,129 (July, 1978), thiazolidine derivatives described in JP-A-50-140129, thiourea derivatives described in U.S. Pat. No. 3,706,561, iodides described in JP-A-58-16235, polyethylene oxide compounds described in West German Patent 2,748,430, and polyamine compounds described in JP-B-45-8836. In addition, compounds described in U.S. Pat. No. 4,552,834 are also preferred. These bleaching promoters may be added to the photographic materials. When bleach-fixing of color photographic materials for shooting is carried out, these bleaching promoters are particularly effective. The mercapto compounds as described in British Patent 1,138,842 and JP-A-2-190856 are particularly preferred.

For the purpose of preventing bleaching stains, in addition to the above-described compounds, organic acids are preferably added to the processing solutions (bleaching solutions and bleach-fixing solutions). Particularly preferred organic acids are compounds having an acid dissociation constant (pKa) of 2 to 5. Preferred examples thereof include acetic acid, lactic acid, malonic acid, glutaric acid, succinic acid, propionic acid and hydroxyacetic acid.

These organic acids are added preferably in an amount of 0.005 to 3 mol per liter of processing solution having bleaching ability.

It is preferred that the total processing time required for the bleaching stage is shorter without causing poor desilverization. The time is preferably 30 seconds to 6 minutes, and more preferably 1 to 3 minutes. Further, the processing temperature is 25° to 50° C., and preferably 35° to 45° C. Within the preferred temperature range, the desilverization speed is improved, and generation of stains after processing is effectively prohibited.

In the present invention, it is particularly preferred that aeration is conducted on the processing solutions having bleaching ability in processing, because the photographic performance is maintained very stable. Any means known in the art can be used for aeration. For example, air can be blown into the processing solutions having bleaching ability, or air can be absorbed into the solutions by use of an ejector.

In blowing air into the solutions, it is preferred to supply air in the solutions through diffusers having fine pores. Such diffusers are widely used in aeration tanks, etc. in the activated sludge procdes. With respect to aeration, the description in Z-121, Using•Process•C-41, third edition, pages BL-1 and BL-2 (published by Eastman Kodak, 1982) can be utilized. In processing using the processing solutions having bleaching ability, it is preferred that stirring is strengthened, and for its practice, the contents described in JP-A-3-33847, page 8, upper right column, line 6 to lower left column, line 2 can be utilized as such.

In the desilvering stage, it is preferred that stirring is strengthened as much as possible. Examples of methods for strengthen stirring include the method for colliding a jet stream of a processing solution onto an emulsion surface of a photographic material described in JP-A-62-183460, the method for enhancing the stirring effect by use of rotating means described in JP-A-62-183461, the method for moving a photographic material while bringing a wiper blade into contact with an emulsion surface to produce turbulence on the emulsion surface, thereby improving the stirring effect, and the method for increasing the overall circulating flow rate of a processing solution. Such means for improving the stirring effect are effective for all of the bleaching, bleach-fixing and fixing solutions. Improved stirring is considered to hasten the supply of the bleaching solutions and the fixing solutions into emulsion films, resulting in an increase in desilvering speed. The above-described means for improving the stirring effect, which are more effective than the bleaching promoters, can significantly enhance the promoting effect and can remove the fixing inhibiting action due to the bleaching promoters.

It is preferred that automatic processors used in the present invention have means for transferring photographic materials described in JP-A-60-191257, JP-A-60-191258 and JP-A-60-191259. As described in JP-A-60-191257, such a transferring means can significantly reduce introduction of the processing solution from a preceding bath to a subsequent bath, and the processing solution is effectively prevented from deteriorations in qualities. Such an effect is particularly effective to shorten the processing time in each stage and to reduce the replenishment rate of the processing solution.

Further, for the processing solutions having bleaching ability used in the present invention, overflowed solutions after use in processing are recovered, and the composition is corrected byaddition of components, whereby the solutions can be reused. Such a method is usually called regeneration. In the present invention, such regeneration is preferably used. As to the details of regeneration, the description in Fuji Film Processing Manual, Fuji Color Negative Film, CN-16 Processing, pages 39 and 40 (revised in August, 1990) published by Fuji Photo Film Co. Ltd. can be applied.

Kits for preparing the processing solutions having bleaching ability may be either in solid form or in liquid form. When ammonium salts are excluded, since almost of all raw materials are supplied in powder form, which are low in moisture absorption, the kits may easily be prepared in the powder form.

Kits for the above-described regeneration are preferably in powder form, because excess water is not used from the viewpoint of a reduction in the amount of waste solution and kits can be directly added.

With respect to the regeneration of the processing solutions having bleaching ability, in addition to the above-described aeration, methods described in *Shashin Kohgaku no Kiso* (*the Elements of Photographic Technology*)-*Ginen Shashinhen* (*the Volume of Silver Salt Photography*), (edited by Nippon Shashin Gakkai (the Photographic Society of Japan), published by Colon, 1979), etc. can be employed. Examples thereof include methods for regenerating the bleaching solutions by use of bromic acid, chlorous acid, bromine, bromine precursors, persulfates, hydrogen peroxide, hydrogen peroxide utilizing catalysts, bromous acid, ozone, etc., as well as electrolytic regeneration.

In regeneration by electrolysis, an anode and a cathode can be placed in the same bleaching solution, or an cathode tank can be separated from an anode tank by use of a diaphragm to conduct regeneration. Further, the bleaching solution and the developing solution and/or the fixing solution can be simultaneously regenerated also using a diaphragm.

The regeneration of the fixing solutions and the bleach-fixing solutions is performed by electrolytic reduction of accumulated silver ions. In addition, it is preferred from the viewpoint of keeping fixing performance to remove accumulated halogen ions through an anion exchange resin.

Bleaching is preferably conducted immediately after color development. In the case of reversal processing, however, bleaching is generally conducted through a compensating bath (which may be a bleaching promoting bath).

The compensating solutions may contain aminopolycarboxylic acid chelating agents such as ethylenediaminetetraacetic acid, diethylenetriaminepentaacetic acid, 1,3-diaminopropanetetraacetic acid and cyclohexanediaminetetraacetic acid; sulfites such as sodium sulfite and ammonium sulfite; and the various bleaching promoters described above such as thioglycerol, aminoethanethiol and sulfoethanethiol. For the purpose of preventing scum, they may contain sorbitan esters of fatty acids substituted by ethylene oxide described in U.S. Pat. No. 4,839,262, and polyoxyethylene compounds described in U.S. Pat. No. 4,059,446 and *Research Disclosure,* 191, 19104 (1980). These compounds are used in an amount of 0.1 to 20 g per liter of compensating solution, and preferably in an amount of 1 to 5 g per liter.

The compensating baths may contain image stabilizers described below.

A pH of the compensating baths is usually 3 to 11, preferably 4 to 9, and more preferably 4.5 to 7. Processing time in the compensating baths is preferably 20 seconds to 5 minutes, more preferably 20 to 100 seconds, and the most preferably 20 to 60 seconds. A replenishment rate of the compensating baths is preferably 30 to 3000 ml per square meter of photographic material, and more preferably 50 to 1500 ml per square meter. The processing temperature of the compensating baths is preferably 20° to 50° C., and more preferably 30° to 40° C.

In the present invention, the photographic materials may be processed in stabilizing baths after subjected to washing after desilverization, or directly processed with stabilizing baths without washing. An amount of washing water used in the washing stage can be widely established depending on the characteristics of the photographic materials (for example, materials used such as couplers), the purpose for use, the temperature of the washing water, the number of washing tanks (the number of stages), the countercurrent or concurrent replenishment system and other various conditions. Of these, the relationship between the amount of the washing water and the number of the washing tanks in the multistage countercurrent system can be determined by the method described in *Journal of the Society of Motion Picture and Television Engineers,* 64, 248–253 (May, 1955). According to the multistage countercurrent system described in the above-described literature, the amount of the washing water can be substantially reduced. However, the increased residence time of the washing water in the tanks causes the problem that bacteria propagates in the water and the resulting suspended matter adheres on the photographic materials. In order to solve such a problem, a method for reducing calcium and magnesium ions described in JP-A-62-288838 can be so effectively used. Disinfectants can also be used, which include isothiazolone compounds and thiazole-benzimidazole derivative, described in JP-A-57-8542; chlorine disinfectants such as chlorinated sodium isocyanurate; benzotriazole; and the disinfectants described in Hiroshi Horiguchi, *Bohkin Bohbaizai no Kagaku* (*Chemistry of Bacteria Prevention and Fungus Prevention*), Sankyo Shuppan (1986), *Biseibutsu no Mekkin, Sakkin, Bohbai Gijutsu* (*Sterilization, Pasteurization and Fungus Prevention Techniques of Microorganisms*), edited by Eisei Gijutsukai, Kogyo Gijutsukai (1982) and *Bokin Bohbaizai Jiten* (*Dictionary of Disinfectants and Fungicides*), edited by Nippon Bohkin Bohbai Gakkai (1986).

The stabilizing solutions used in the present invention generally contain formaldehyde, and known stabilizing solutions and processing methods described in U.S. Pat. Nos. 4,786,583 and 4,859,574, JP-A-3-33847, JP-A-4-270344, JP-A-4-313753, JP-A-4-359249, JP-A-5-34889, JP-A-5-165178, JP-A-57-8543, JP-A-58-14834 and JP-A-60-220345 can be applied.

The stabilizing solutions used in the present invention contain compounds for stabilizing color images (hereinafter referred to as image stabilizers). Examples of the image stabilizers include formalin, benzaldehyde compounds such as m-hydroxybenzaldehyde, formaldehyde-bisulfite addition compounds, hexamethylenetetramine and derivatives thereof, hexahydrotriazine and derivatives thereof, and N-methylol compounds such as dimethylolurea and N-methylolpyrazole. In the present invention, when the concentration of free formaldehyde in the solutions is 0 to 0.01%, and further 0 to 0.005%, the effect is preferably enhanced. Preferred examples of the image stabilizers to provide such a free formaldehyde concentration, include m-hydroxybenzaldehyde, hexamethylenetetramine, N-methylolazoles described in JP-A-4-270344 such as N-methylolpyrazole, azolylmethylamines described in JP-A-4-313753 such as N,N'-bis(1,2,4-triazole-1-ylmethyl) piperazine. In particular, it is preferred to use azole compounds such as 1,2,4-triazole described in JP-A-4-359249 (corresponding to European Patent No. 519190A2) in combination with azolylmethyl-amines and derivatives thereof such as 1,4-bis(1,2,4-triazole-1-ylmethyl)piperazine.

The content of these image stabilizers is preferably 0.001 to 0.1 mol per liter of stabilizing solution, and more preferably 0.001 to 0.05 mol per liter.

In the present invention, it is preferred in view of reducing stains that the stabilizing solution contains a monobasic organic acid having at least one hydroxyl group.

The hydroxyl group-containing monobasic organic acid used in the present invention comprises a hydroxyl group moiety and a straight-chain or branched alkyl group having an organic acid moiety. The compound preferably has 2 to 6 carbon atoms, and more preferably has 2 to 4 carbon atoms. Preferred examples of the organic acid moieties include carboxylic acid, sulfonic acid and phosphoric acid, and carboxylic acid is particularly preferred.

That is to say, compounds represented by following formula (FB) are preferred:

$$HO—L—COOH \qquad (FB)$$

wherein L represents a straight-chain or branched alkylene group having 1 to 5 carbon atoms.

Examples of the hydroxyl group-containing monobasic organic acids used in the present invention are enumerated below, but are not limited thereto.

FB-1: $HOCH_2COOH$

FB-2: $HOCH_2CH_2COOH$

FB-3: $HOCH(CH_3)COOH$

FB-4: $HOCH(CH_2CH_3)COOH$

FB-5: $HOCH(CH_3)CH_2COOH$

FB-6: $HOCH_2CH_2CH_2COOH$

FB-7: $HOCH_2CH_2CH_2CH_2COOH$

Of the above-described organic acids, FB-1 and FB-2 are preferred, and FB-1 is particularly preferred.

The content of these organic acids is preferably 0.00001 to 0.5 mol per liter of stabilizing solution, and more preferably 0.0001 to 0.1 mol per liter.

It is preferred that the stabilizing solutions used in the present invention contain various surfactants to prevent water spots from being produced in drying the photographic materials after processing. Such surfactants include polyethylene glycol type nonionic surfactants, polyhydric alcohol type nonionic surfactants, alkylbenzene-sulfonate type anionic surfactants, higher alcohol sulfate ester type anionic surfactants, alkylnaphthalenesulfonate type anionic surfactants, quaternary ammonium salt type cationic surfactants, amine salt type cationic surfactants, amino salt type cationic surfactants and betaine type amphoteric surfactants. The nonionic surfactants are preferably used, and alkylphenoxypolyethylene oxides and alkylphenoxypolyhydroxypropylene oxides are particularly preferred.

Further, the use of silicone surfactants having a high antifoaming effect is also preferred. The surfactants are added in an amount of 0.005 to 3 g per liter of stabilizing solution, and preferably in an amount of 0.02 to 0.3 g per liter.

In addition, it is preferred that the stabilizating solutions may also contain ammonium compounds such as ammonium chloride and ammonium sulfite, compounds of metals such as Bi and Al, fluorescent brighteners, hardening agents, alkanolamines described in U.S. Pat. No. 4,786,583 and sulfinic acid compounds described in JP-A-1-231051 if necessary.

In order to improve the stability of the stabilizing solutions and reduce generation of stains, it is preferred that the stabilizing solutions used in the present invention contain various chelating agents. Preferred examples of the chelating agents include organic carboxylic acid chelating agents, organic phosphoric acid chelating agents, inorganic phosphoric acid chelating agents and polyhydroxy compounds. Particularly preferred examples of the chelating agents include aminopolycarboxylic acids such as ethylenediaminetetraacetic acid and diethylenetriamine-pentaacetic acid; organic phosphonic acids such as 1-hydroxyethylidene-1,1-diphosphonic acid and diethylenetri-amine-N,N,N',N'-tetramethylenephosphonic acid; and hydrolyzed products of maleic anhydride polymers described in European Patent 345172A1. These chelating agents are preferably added in an amount 0.00001 to 0.01 mol per liter of stabilizing solution.

For the purpose of preventing generation of bacteria and molds, the stabilizing solutions preferably contain antibacterial agents and antifungal agents. As such agents, commercially available agents can be used. Examples of such antibacterial agents and antifungal agents include thiazolylbenzoimidazole compounds described in JP-A-57-157244 and JP-A-58-105145; isothiazolone compounds described in JP-A-57-8542; chlorophenol compounds represented by trichlorophenol; bromophenol compounds; organotin or organozinc compounds; acid amide compounds; diazine or triazine compounds; thiourea compounds; benzotriazole compounds; alkylguanidine compounds; quaternary ammonium salts represented by benzalkonium chloride; antibiotics represented by penicillin and aminoglycosides; and general-purpose antifungal agents described in *J. Antibact. Antifung. Agents*, Vol. 11, No. 5, pages 207 to 223 (1983). Further, various disinfectants described in JP-A-48-83820, chlorine disinfectants such as chlorinated sodium isocyanurate, and disinfectants described in Hiroshi Horiguchi, *Bohkin Bohbaizai no Kagaku* (*Chemistry of Anti-Bacteria and Anti-Fungus*), Sankyo Shuppan (1986), *Biseibutsu no Mekkin, Sakkin, Bohbai Gijutsu* (*Sterilization, Pasteurization and Fungus Prevention Techniques of Microorganisms*), edited by Eisei Gijutsukai, Kogyo Gijutsukai (1982) and *Bokin Bohbaizai Jiten* (*Dictionary of Disinfectants and Fungicides*), edited by Nippon Bohkin Bohbai Gakkai (1986) can also be used. These agents may be used in combination. In the present invention, aminoglycosides described in *The Merck Index, Eleventh Edition*, Merck & Co., Inc., 1989 are preferably used as the antibacterial agents and antifungal agents in the stabilizing solutions. Of the aminoglycosides, gentamicins are particularly preferred. In particular, in the stabilizing solutions having a low free formaldehyde concentration as described above, the resulting suspended matter is prevented from adhering to the photographic materials.

These antibacterial agents and antifungal agents are added in an amount of 0.001 to 1 g per liter of stabilizing solution, and preferably 0.005 to 0.5 g per liter.

The pH of the stabilizing solutions and washing water used in the present invention is 4 to 9, and preferably 5 to 8.

The processing temperature and the processing time can be variously set according to the characteristics and the use of the photographic materials. In general, however, the processing time is 20 seconds to 10 minutes at a processing temperature of 15° to 45° C., and preferably 30 seconds to 2 minutes at a processing temperature of 25° to 40° C. Further, for the stabilizing solutions used in the present invention, direct processing with the stabilizing solutions subsequent to desilveriztion without washing results in the significant effect of preventing stains.

The replenishment rate of the stabilizing solutions used in the present invention is preferably 200 to 2000 ml per square meter of photographic material. Overflowed solutions caused by replenishment of the washing water and/or the stabilizing solutions can be reused in other stages such as the desilvering stage.

In order to reduce the amount of washing water, ion exchange or ultrafiltration may be employed. In particular, ultrafiltration is preferably used.

In the present invention, the various processing solutions are used at 10° to 50° C. Although the standard temperature is usually 33° to 38° C., the temperature can be elevated higher to promote processing, thereby shortening the processing time, or conversely, the temperature can be decreased lower to improve the image quality or the stability of the processing solutions.

When the various processing solutions described above are concentrated by evaporation in processing using automatic processors, etc., it is preferred that an appropriate amount of water, correcting solutions or processing replenishers is replenished to correct concentration due to evaporation. Although there is no particular restriction on specific processes for replenishing water, the following processes are preferably used among others:

(1) The process of determining the amount of evaporated water in a monitor water tank provided separately from a bleaching tank, calculating the amount of evaporated water in the bleaching tank from the amount of evaporated water in the monitor tank, and replenishing water to the bleaching tank in proportion to the determined amount of evaporated water (described in JP-A-1-254959 or JP-A-1-254960); and (2) The process for correcting evaporation by using a liquid level sensor or an overflow sensor (described in JP-A-3-248155, JP-A-3-249644, JP-A-3-249645 or JP-A-3-249646.

Water for replenishing evaporated water may be service water, but is preferably deionized or sterilized water preferably used in the above-described washing stage.

The photographic materials of the present invention are described below in detail.

The film thickness of the photographic material of the present invention means the thickness of a film on the side having an emulsion layer measured after preserving under a condition of at 25° C., 55% RH (for 2 days). In the present invention, the film thickness is preferably 9 to 18 μm, and more preferably 10 to 14 μm.

Further, the film swelling speed T/2 is 1 to 30 seconds, and more preferably 3 to 20 seconds. The film swelling speed can be measured by techniques known in the art. For example, the film swelling speed can be measured by using a swellometer described in A. Green et al., *Photogr. Sci. Eng.* Vol. 19, No. 2, pages 124 to 129, and 90% of the maximum swelled film thickness which the photographic material reaches when processed in a color developing solution at 30° C. for 3 minutes and 15 seconds is taken as a saturated swelled film thickness, and the time taken to reach one-half this film thickness is defined as T/2.

The film swelling speed T/2 can be adjusted by adding a hardening agent as a binder or changing the above-described aging conditions after coating. The swelling rate is preferably 150 to 400%. The swelling rate can be calculated according to the equation: (maximum swelled film thickness—film thickness)/film thickness, from the maximum swelled film thickness under the above-described conditions.

The photographic material according to the present invention is preferably provided with a hydrophilic colloidal layer (referred to as a back layer) having a total dry film thickness of 2 to 20 μm on the side opposite to a side having an emulsion layer. It is preferred that the back layers contain the above-described light absorbers, filter dyes, ultraviolet absorbers, antistatic agents, hardening agents, binders, plasticizers, lubricants, coating aids and surfactants. The swelling rate of the back layers is preferably 150 to 500%.

The photographic material of the present invention is preferred to have a hydrophilic colloidal layer containing at least one kind of dye as a finely divided solid grain dispersion, because the effect of the present invention is sufficiently exhibited.

In particular, as such a dye used in a form of the finely divided solid grain dispersion, a dye represented by the following formula (I) is preferably used:

$$D-(X)_y \qquad (I)$$

wherein D represents a compound having a chromophore; X represents a dissociative proton combined with D directly or through a divalent binding group or a group having the dissociative proton; and y represents an integer of 1 to 7.

The dye represented by formula (I) is described below in detail.

The compound having the chromophore represented by D can be selected from many known dye compounds. Such compounds include oxonol dyes, merocyanine dyes, cyanine dyes, arylidene dyes, azomethine dyes, triphenylmethane dyes, azo dyes, anthraquinone dyes and indoaniline dyes.

The dissociative proton represented by X or the group having the dissociative proton is undissociated in a state, in where the compound represented by (I) is added to the silver halide color photographic material of the present invention are non-dissociated, thereby making the compound represented by formula (I) substantially water insoluble, contrarily, the proton and group having proton are dissociated in a stage where the material is subjected to development (particularly under high alkaline conditions, specifically under conditions of pH 9 to 12) to have a property for making the compound represented by formula (I) substantially water soluble. Examples of the groups include carboxylic acid, sulfonamido, arylsulfamoyl, sulfonylcarbamoyl, carbonyl-sulfamoyl, enol of an oxonol dye and phenolic hydroxyl group.

Of the compounds represented by general formula (I), more preferred examples are compounds represented by the following formulas (II), (III), (IV) and (V):

$$A_1=L_1\leftarrow L_2=L_3\rangle_m Q \qquad (II)$$

-continued $$A_1{=}L_1{\leftarrow}L_2{=}L_3{\rangle}_m A_2 \quad \text{(III)}$$

$$A_1{\leftarrow}L_1{-}L_2{\rangle}_p B_1 \quad \text{(IV)}$$

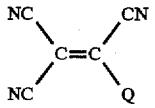

(V)

wherein $A_1$ and $A_2$ each represents an acidic nucleus; $B_1$ represents a basic nucleus; Q represents an aryl group or a heterocyclic group; $L_1$, $L_2$ and $L_3$ each represents a methine group; m represents 0, 1 or 2; and n and p each represents 0, 1, 2 or 3, with the proviso that the compound represented by formula (II), (III), (IV) or (V) has at least one group selected from the group consisting of a carboxylic acid group, a sulfonamido group, an arylsulfamoyl group, a sulfonylcarbamoyl group, a carbonylsulfamoyl group, an enol group of an oxonol dye and a phenolic hydroxyl group in one molecule, and has no more water soluble group (for example, a sulfonic acid group or a phosphoric acid group).

The acidic nucleus represented by $A_1$ or $A_2$ is preferably a cyclic ketomethylene compound or a compound having a methylene group between electron attractive groups. Examples of the cyclic ketomethylene compounds include 2-pyrazolin-5-one, rhodanine, hydantoin, thiohydantoin, 2,4-oxazolidinedione, isooxazolone, barbituric acid, thiobarbituric acid, indandione, dioxopyrazolopyridine, hydroxypyridone, pyrazolidinedione and 2,5-dihydrofuran, each of which may have a substituent group.

The compound having the methylene group between the electron attractive groups can be represented by $Z_1CH_2Z_2$, wherein $Z_1$ and $Z_2$ each represents CN, $SO_2R_1$, $COR_1$, $COOR_2$, $CONHR_2$, $SO_2NHR_2$, $C[{=}C(CN)_2]R_1$ or $C[{=}C(CN)_2]NHR_1$; $R_1$ represents an alkyl group, an aryl group or a heterocyclic group; and $R_2$ represents a hydrogen atom or a group represented by $R_1$, each of which may have a substituent group.

Examples of the basic nuclei represented by $B_1$ include pyridine, quinoline, indolenine, oxazole, imidazole, thiazole, benzoxazole, benzimidazole, benzothiazole, oxazoline, naphthoxazole and pyrrole, each of which may have a substituent group.

Examples of the aryl groups represented by Q include phenyl and naphthyl groups, each of which may have a substituent group. Examples of the heterocyclic groups represented by Q include pyrrole, indole, furan, thiophene, imidazole, pyrazole, inzolidine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin and coumarone, each of which may have a substituent group.

The methine group represented by $L_1$, $L_2$ or $L_3$ may have a substituent group. The substituent groups may combine with each other to form a 5-membered or 6-membered ring (for example, cyclopentene or cyclohexene).

There is no particular limitation on the substituent groups which the above-described respective groups may have, as long as they are not substituent groups which solubilize the compounds represented by general formulas (I) to (V) in water having a pH of 5 to 7. Examples of the substituent groups include a carboxylic acid group, sulfonamido groups having 1 to 10 carbon atoms (for example, methanesulfonamido, benzenesulfonamido, butanesulfonamido and n-octanesulfonamido), sulfamoyl groups having 0 to 10 carbon atoms (for example, unsubstituted sulfamoyl, methylsulfamoyl, phenylsulfamoyl and butylsulfamoyl), sulfonylcarbamoyl groups having 2 to 10 carbon atoms (for example, methanesulfonyl-carbamoyl, propanesulfonylcarbamoyl and benzenesulfonyl-carbamoyl), acylsulfamoyl groups having 1 to 10 carbon atoms (for example, acetylsulfamoyl, propionylsulfamoyl, pivaloyl-sulfamoyl and benzoylsulfamoyl), chain or cyclic alkyl groups having 1 to 8 carbon atoms (for example, methyl, ethyl, isopropyl, butyl, hexyl, cyclopropyl, cyclopentyl, cyclohexyl, 2-hydroxyethyl, 4-carboxybutyl, 2-methoxyethyl, benzyl, phenetyl, 4-carboxybenzyl and 2-diethylaminoethyl), alkenyl groups having 2 to 8 carbon atoms (for example, vinyl and allyl), alkoxyl groups having 1 to 8 carbon atoms (for example, methoxy, ethoxy and butoxy), halogen atoms (for example, F, Cl and Br), amino groups having 0 to 10 carbon atoms (for example, unsubstituted amino, dimethylamino, diethylamino and carboxyethylamino), alkoxycarbonyl groups having 2 to 10 carbon atoms (for example, methoxycarbonyl), amido groups having 1 to 10 carbon atoms (for example, acetylamino and benzamido), carbamoyl groups having 1 to 10 carbon atoms (for example, unsubstituted carbamoyl, methylcarbamoyl and ethylcarbamoyl), aryl groups having 6 to 10 carbon atoms (for example, phenyl, naphthyl, 4-carboxyphenyl, 3-carboxyphenyl, 3,5-dicarboxyphenyl, 4-methanesulfonamidophenyl and 4-butanesulfonamidophenyl), aryloxy groups having 6 to 10 carbon atoms (for example, phenoxy, 4-carboxyphenoxy, 3-methylphenoxy and naphthoxy), alkylthio groups having 1 to 8 carbon atoms (for example, methylthio, ethylthio and octylthio), arylthio groups having 6 to 10 carbon atoms (for example, phenylthio and naphthylthio), acyl groups having 1 to 10 carbon atoms (for example, acetyl, benzoyl and propanoyl), sulfonyl groups having 1 to 10 carbon atoms (for example, methanesulfonyl and benzenesulfonyl), ureido groups having 1 to 10 carbon atoms (for example, ureido and methylureido), urethane groups having 2 to 10 carbon atoms (for example, methoxycarbonylamino and ethoxycarbonylamino), a cyano group, a hydroxyl group, a nitro group, and heterocyclic groups (for example, a 5-carboxybenzoxazole ring, a pyridazine ring, a sulfolane ring, a pyrrole ring, a pyrrolidine ring, a morpholine ring, a piperazine ring and a pyrimidine ring).

The dyes represented by formula (I) which are contained as the finely divided solid grain dispersions are added preferably in an amount of $5\times10^{-2}$ to $5\times10^{-7}$ mol/m$^2$, and more preferably $1\times10^{-3}$ to $5\times10^{-5}$ mol/m$^2$.

Examples of the compounds represented by formula (I) to (V) are enumerated below, but the present invention is not limited thereto.

(I-1)
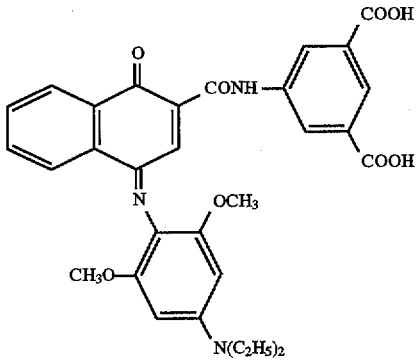
(I-2)
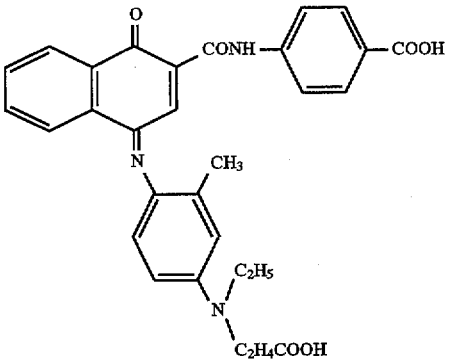
(I-3)
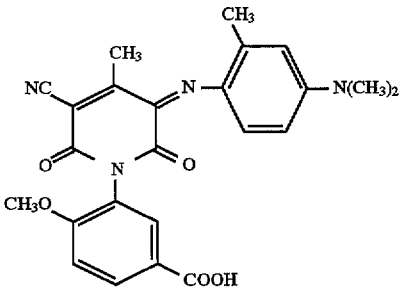
(I-4)
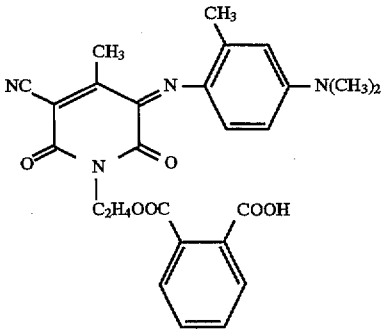
(II-1)
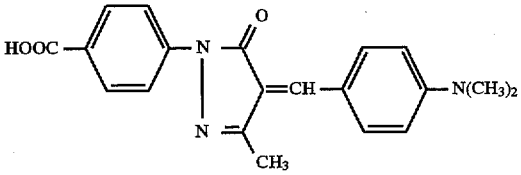

-continued
(II-2)
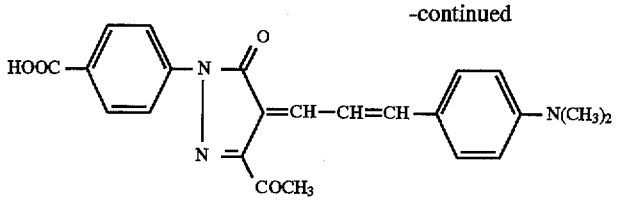
(II-3)
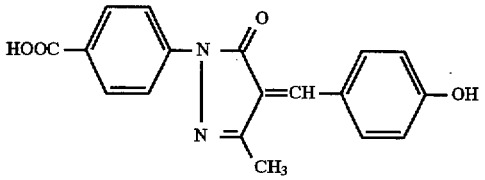
(II-4)
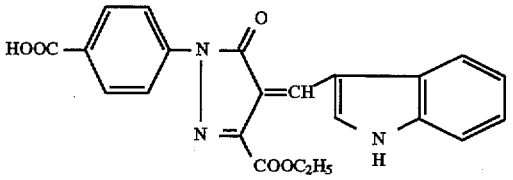
(II-5)
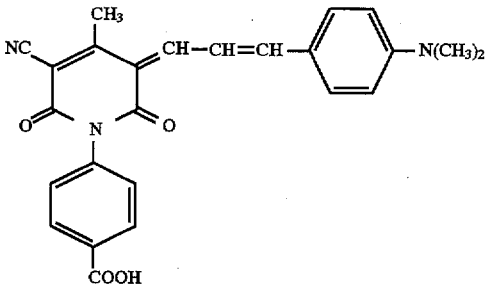
(II-6)
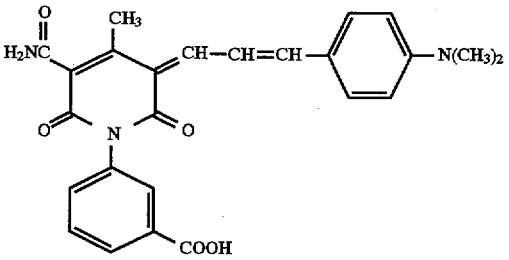
(II-7)
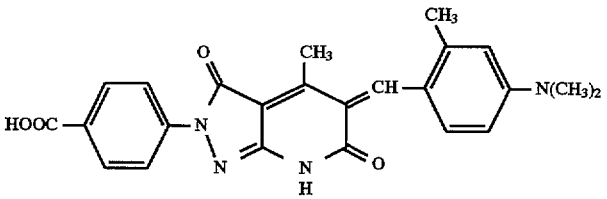
(II-8)
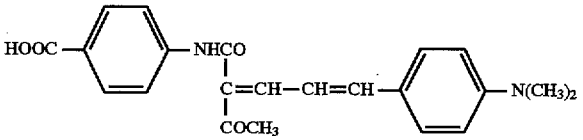
(II-9)
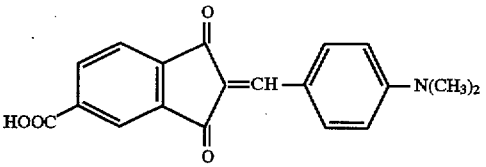

-continued
(II-10)
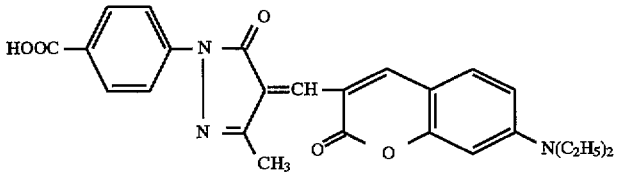
(II-11)
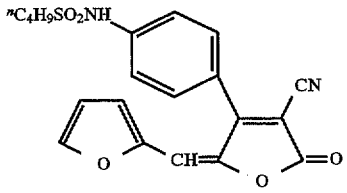
(II-12)
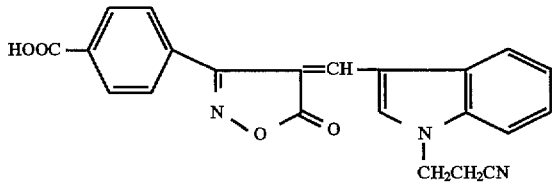
(II-13)
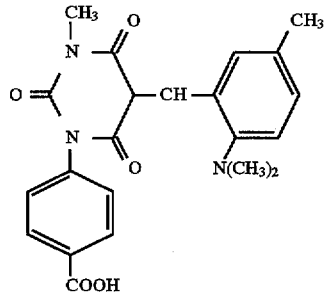
(II-14)
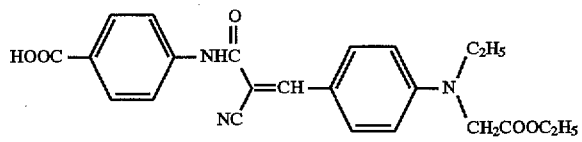
(II-15)
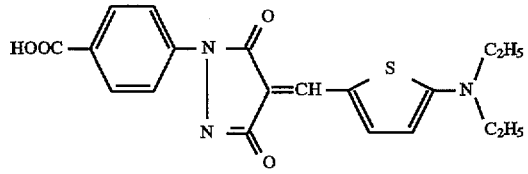
(II-16)
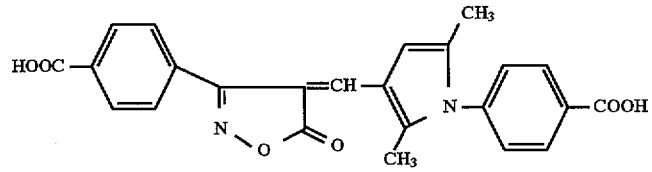
(II-17)
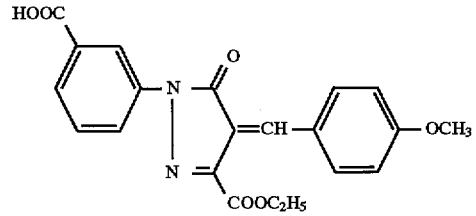

-continued
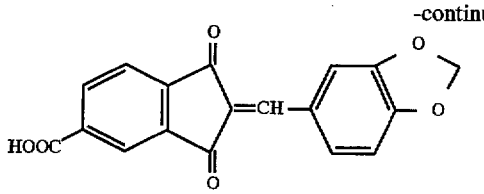
(II-18)
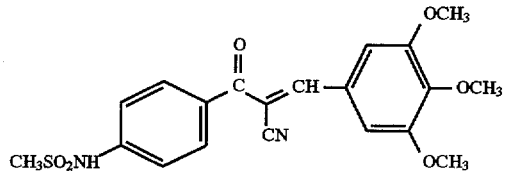
(II-19)
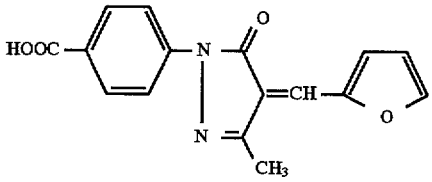
(II-20)
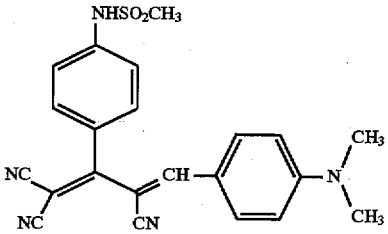
(II-21)
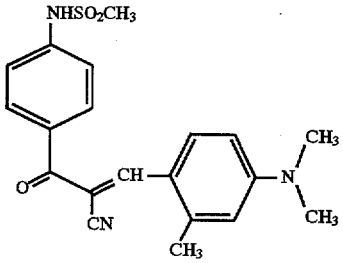
(II-22)
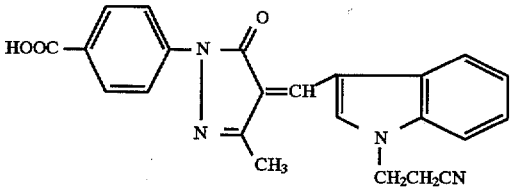
(II-23)
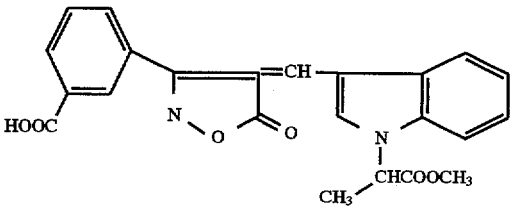
(II-24)
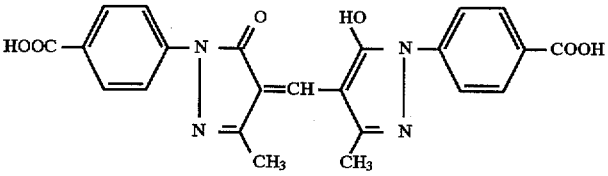
(III-1)

-continued
(III-2)
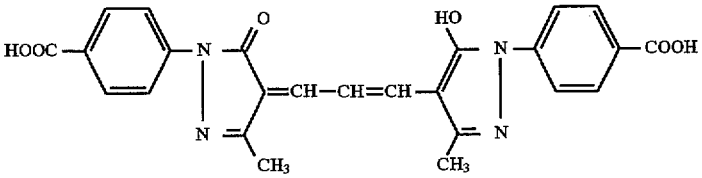
(III-3)
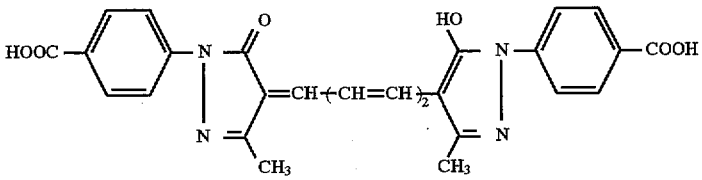
(III-4)
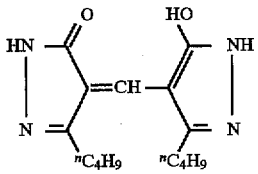
(III-5)
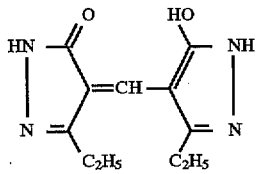
(III-6)
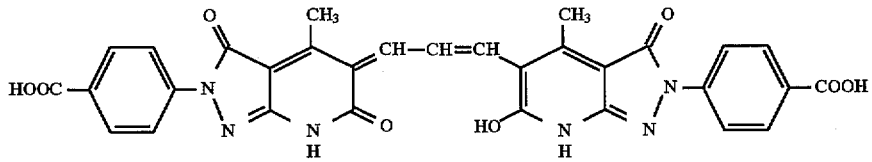
(III-7)
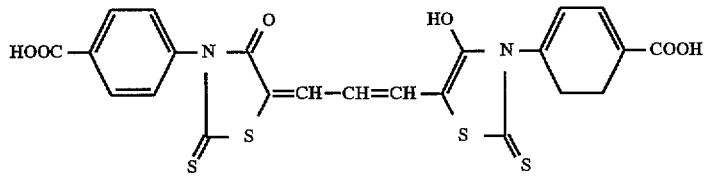
(III-8)
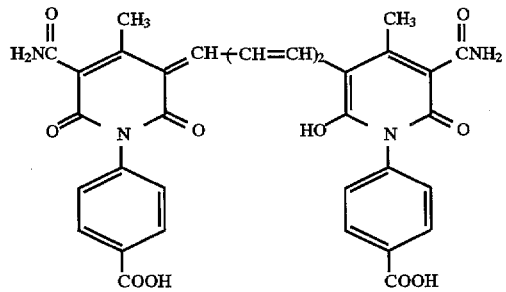
(III-9)
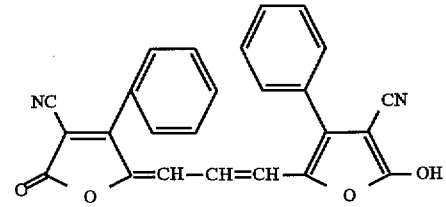

-continued
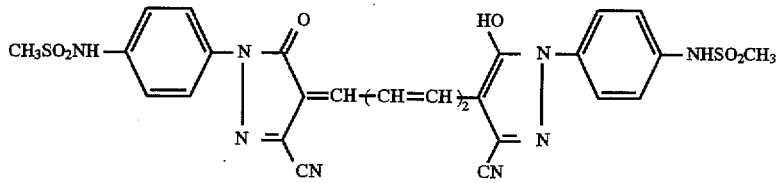
(III-10)
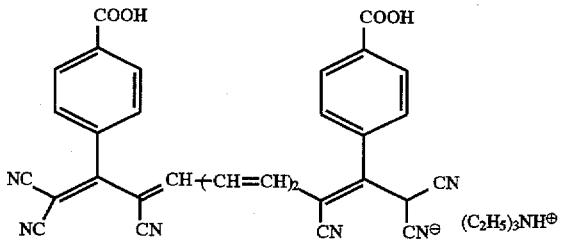
(III-11)
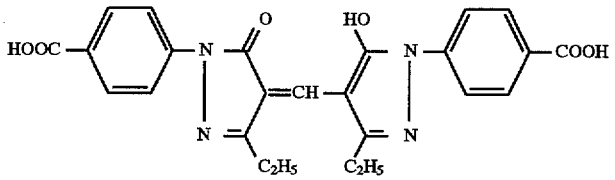
(III-12)
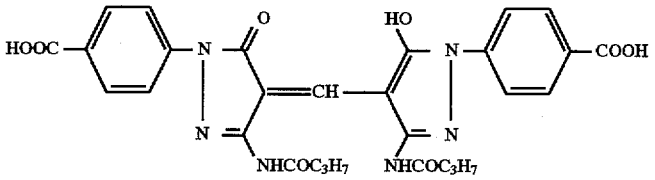
(III-13)
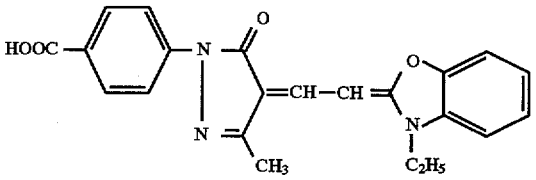
(IV-1)
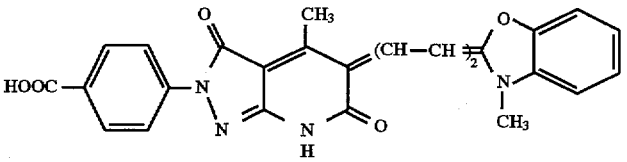
(IV-2)
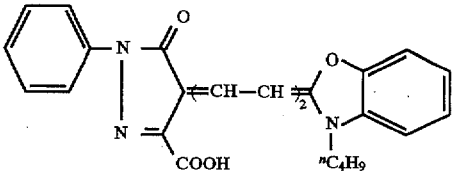
(IV-3)
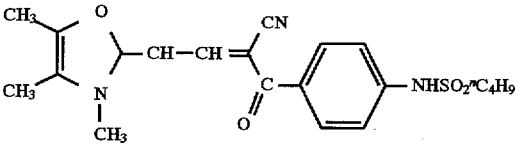
(IV-4)

-continued (IV-5)

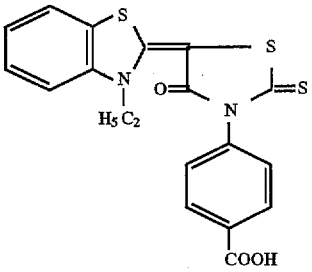

(IV-6)

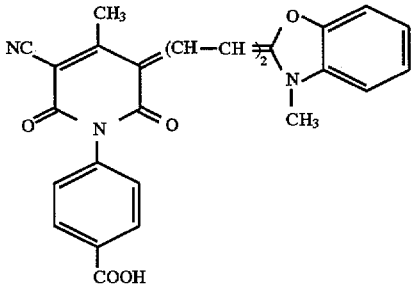

(II-17)

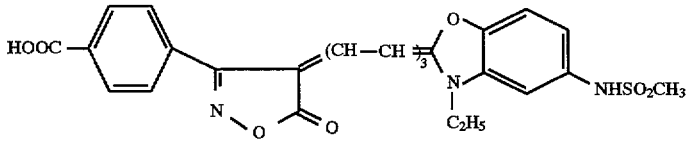

(V-1)

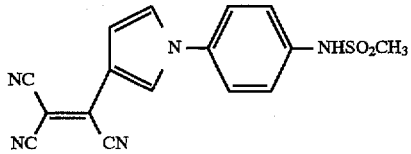

(V-2)

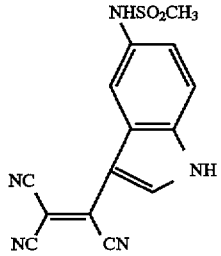

(V-3)

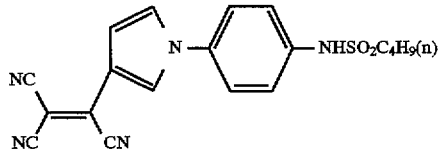

The dyes used in the present invention can be synthesized by methods described in PCT International Publication No. W088/04794, European Patents EP274723Al, 276,566 and 299,435, JP-A-52-92716, JP-A-55-155350, JP-A-55-155351, JP-A-61-205934, JP-A-48-68623, U.S. Pat. Nos, 2,527,583, 3,486,897, 3,746,539, 3,933,798, 4,130,429 and 4,040,841, JP-A-3-282244, JP-A-3-7931 and JP-A-3-167546, or in accordance with the methods disclosed therein.

The finely divided solid grain dispersions of the dyes represented by formula (I) can be used in either emulsion layers or other hydrophilic colloidal layers, and may be used in either a single layer or plural layers.

The finely divided solid grain dispersions of the dyes represented by formula (I) used in the present invention can be formed by known grinding methods in the presence of dispersants (for example, in a ball mill, a vibrating ball mill, a planetary ball mill, a sand mill, a colloid mill, a jet mill or a roller mill). In these cases, solvents (such as water and alcohols) may be coexisted. The dyes used in the present invention may be dissolved in appropriate solvents, followed by adding bad solvents for the dyes to precipitate fine crystals. In these cases, surfactants for dispersion may be used. The dyes may first be dissolved by controlling the pH, followed by changing in pH to form fine crystals.

Fine crystalline grains of the dyes contained in the dispersions used in the present invention have an average grain size of 0.005 to 10 μm, preferably 0.01 to 1 μm, and more preferably 0.01 to 0.5 μm. In some cases, the average grain size is preferably 0.01 to 0.1 μm.

The dye dispersions used in the present invention can be added to any layers inclusive of emulsion layers or intermediate layers.

It is particularly preferred that the dye dispersions are partially or wholly substituted by colloidal silver usually used in yellow filter layers and antihalation layers.

In particular, when the dye dispersions used in the present invention are wholly substituted by colloidal silver of the yellow filter layers, the effect is markedly exhibited.

The photographic material of the present invention only requires that a support is provided with at least one layer of silver halide emulsion layers such as blue-sensitive, green-sensitive and red-sensitive layers. There is no particular limitation on the number and the order of arrangement of the silver halide emulsion layers and insensitive layers. A typical example thereof has at least one light-sensitive layer on a support, the light-sensitive layer comprising a plurality of silver halide emulsion layers which are substantially identical in color feelings but different in light sensitivity. Said light-sensitive layer is a unit light-sensitive layer having color sensitivity to any of blue, green and red lights. In the unit light-sensitive layer of the multilayer silver halide color photographic material, the red-sensitive layer, the green-sensitive layer and the blue-sensitive layer are generally arranged from the support side in this order. However, the above-described arrangement order may be reversed, or such an arrangement that a layer having a different color sensitivity is interposed between layers having the same color sensitivity may also be adopted, depending on its purpose.

A insensitive layer, such as various type intermediate layer, may be provided between the above-descried silver halide light-sensitive layers, or as the most upper layer, or the most lower layer.

The above mentioned intermediate layers may contain couplers or DIR compounds described in JP-A-61-43748, JP-A-59-113438, JP-A-59-113440, JP-A-61-20037 and JP-A-61-20038, and may contain color mixing inhibitors, as usually employed.

As the plural silver halide emulsion layers constituting each unit light-sensitive layer, a two-layer structure composed of a high sensitive emulsion layer and a low sensitive emulsion layer, can be preferably used as described in West German Patent 1,121,470 and British Patent 923,045. It is usually preferred that the emulsion layers are arranged so as to decrease in light sensitivity toward a support in turn. The insensitive layer may also be provided between the respective halogen emulsion layers. Further, low sensitive emulsion layers may be arranged apart from a support and high sensitive layers near to the support, as described in JP-A-57-112751, JP-A-62-200350, JP-A-62-206541 and JP-A-62-206543.

Examples thereof include an arrangement in the order of low sensitive blue-sensitive layer (hereinafter referred to as BL)/high sensitive blue-sensitive layer (hereinafter referred to as BH)/high sensitive green-sensitive layer (hereinafter referred to as GH)/low sensitive green-sensitive layer (hereinafter referred to as GL)/high sensitive red-sensitive layer (hereinafter referred to as RH)/low sensitive red-sensitive layer (hereinafter referred to as RL) from the farthest side from a support; an arrangement in the order of BH/BL/GL/GH/RH/RL; and an arrangement in the order of BH/BL/GH/GL/RL/RH.

As described in JP-B-55-34932, layers can also be arranged in the order of blue-sensitive layer/GH/RH/GL/RL from the farthest side from a support. Further, layers can also be arranged in the order of blue-sensitive layer/GL/RL/GH/RH from the farthest side from a support, as described in JP-A-56-25738 and JP-A-62-63936.

Furthermore, three layers different in light sensitivity may be arranged so that the upper layer is a silver halide emulsion layer having the highest light sensitivity, the middle layer is a silver halide emulsion layer having a light sensitivity lower than of the upper layer, and the lower layer is a silver halide emulsion layer having a light sensitivity further lower than of the middle layer, and the sensitivity of the three layers is successively decreased toward a support, as described in JP-B-49-15495. Even when such three layers having different in light sensitivity are arranged, they may be arranged in the order of intermediate sensitive emulsion layer/high sensitive emulsion layer/low sensitive layer from the side appart from the support in the same color-feeling layer, as described in JP-A-59-202464.

In addition, the layer arrangement may be changed in the order of high sensitive emulsion layer/low sensitive emulsion layer/intermediate sensitive emulsion layer, or low sensitive emulsion layer/intermediate sensitive emulsion layer/high sensitive emulsion layer. In the case of four or more layers, the arrangement may also be changed as described above.

In order to improve color reproducibility, a donor layer (CL) having multilayer effect different in spectral sensitivity from a main light-sensitive layer such as BL, GL or RL may be arranged adjacent to or in the vicinity of the main light-sensitive layer as described in U.S. Pat. Nos. 4,663,271, 4,705,744 and 4,707,436, JP-A-62-160448 and JP-A-63-89850.

As described above, various layer structures and arrangements can be selected depending on the purpose of each photographic material. Preferred silver halides contained in the photographic emulsion layers of the photographic materials used in the present invention are silver iodobromide, silver iodochloride and silver iodochlorobromide containing about 0.2 to about 30 mol % of silver iodide. Silver iodobromide and silver iodochlorobromide containing about 2 to about 10 mol % of silver iodide are particularly preferred.

Silver halide grains contained in the photographic emulsions may have a regular crystal form such as a cubic, an octahedral or a tetradecahedral, an irregular crystal form such as a spherical or tabular form, a form having a crystal defect such as a twin plane, or a combined form thereof.

The silver halides may be either finely divided grains having a grain size of about 0.2 μm or less, or large-sized grains having a diameter of a projected area up to about 10 μm. Further, they may be either polydisperse emulsions or monodisperse emulsions.

The silver halide emulsions which can be used in the present invention can be prepared, for example, according to the methods described in *Research Disclosure* (*RD*), No. 17643, pages 22 and 23, "I. Emulsion Preparation and Types" (December, 1978), ibid., No. 18716, page 648 (November, 1979), ibid., No. 307105, pages 863 to 865 (November, 1979), P. Glafkides, *Chimie et Phisique Photograhique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

The monodisperse emulsions described in U.S. Pat. Nos. 3,574,628 and 3,655,394 and British Patent 1,413,748 are also preferably used.

Further, tabular grains having an aspect ratio of 3 or more can also be used in the present invention. The tabular grains can be easily prepared by the methods described in Gutoff,

*Photographic Science and Engineering*, Vol. 14, pages 248 to 257 (1970), U.S. Pat. Nos. 4,434,226, 4,414,310, 4,433,048 and 4,439,520 and British Patent 2,112,157.

A crystal structure may be uniform, or the interior of the grain may be different from the surface thereof in halogen composition. The crystal structure may also be a laminar structure. Silver halide grains different in composition may be joined together by epitaxial bonding. Further, silver halide grains may be joined to compounds other than silver halides, such as silver rhodanide and lead oxide. Furthermore, mixtures of grains having various crystal forms may also be used.

The above-described emulsions may be any of surface latent image type emulsions in which latent images are mainly formed on the surface of the grains, internal latent image type emulsions in which latent images are mainly formed in the interior of the grains and emulsions in which latent images are formed both on the surface and in the interior. However, the emulsions are required to be negative type emulsions. One of the internal latent image type emulsions may be the internal latent image type emulsion of a core/shell type described in JP-A-63-264740. A method for preparing this internal latent image type emulsion of a core/shell type is described in JP-A-59-133542. A thickness of the shell of this emulsion is preferably 3 to 40 nmand more preferably 5 to 20 nm, though it varies depending on development processing and the like.

The silver halide emulsions subjected to physical ripening, chemical ripening and spectral sensitization are usually employed. Additives used in such stages are described in *Research Disclosure*, No. 17643, ibid., No. 18716 and ibid., No. 307105, and corresponding portions thereof are summarized in the following table.

In the photographic materials according to the present invention, two or more kinds of emulsions which are different in at least one characteristic of the grain size, grain size distribution, halogen composition, grain shape and sensitivity of the sensitive silver halide emulsions can be mixed to use them in the same layer.

Silver halide grains described in U.S. Pat. No. 4,082,553, the surfaces of which are fogged, and silver halide grains and colloidal silver described in U.S. Pat. No. 4,626,498 and JP-A-59-214852, the interiors of which are fogged, can be preferably used in sensitive silver halide emulsion layers and/or substantially insensitive hydrophilic colloidal layers. The silver halide grains, the surfaces and/or the interiors of which are fogged, mean silver halide grains which can be uniformly (non-imagewisely) developed, independently of non-exposed or exposed portions of the photographic materials. Methods for preparing the silver halide grains the surfaces or the interiors of which are fogged are described in U.S. Pat. No. 4,626,498 and JP-A-59-214852.

Silver halides forming internal nuclei of core/shell type silver halide grains, the interiors of which are fogged may be the same or different in halogen composition. As the silver halide in which the interiors of the grains are fogged, any of silver chloride, silver chlorobromide, silver iodobromide and silver chloroiodo-bromide can be used. Although there is no particular limitation on the grain size of these fogged silver halide grains, the average grain size is preferably 0.01 to 0.75 μm, and more preferably 0.05 to 0.6 μm. There in no particular limitation on the grain shape. Although an emulsion comprising regular grains and a polydisperse emulsion may be used, a monodisperse emulsion (in which at least 95% of the weight or a number of silver halide grains has a grain size within ±40% of the average grain size) is preferably used.

In the present invention, it is preferred that fine insensitive silver halide grains are used. The fine insensitive silver halide grains are fine silver halide grains which are not sensitive to light on imagewise exposure for obtaining dye images and are not substantially developed by their processing, and it is preferred that the grains are not fogged previously.

The fine silver halide grains contain 0 to 100 mol % of silver bromide, and may contain silver chloride and/or silver iodide, on demand. It is preferred that the fine silver halide grains contain 0.5 to 10 mol % of silver iodide.

The fine silver halide grains preferably have an average grain size (a mean value of circle corresponding diameters of projected areas) of 0.01 to 0.5 μm, and more preferably 0.02 to 0.2 μm.

The fine silver halide grains can be prepared in a manner similar to that for preparing conventional sensitive silver halide grains. In this case, the surface of the silver halide grains is neither required to be chemically sensitized, nor spectrally sensitized. It is however preferred that known stabilizers such as triazole, azaindene, benzothiazolium, mercapto and zinc compounds are previously added to the fine silver halide grains before they are added to coating solutions. Colloidal silver can be preferably added to the fine silver halide grain-containing layers.

The photographic materials according to the present invention are applied preferably in a silver amount of 10.0 $g/m^2$ or less, more preferably 6.0 $g/m^2$ or less, and the most preferably 2.0 to 4.5 $g/m^2$.

Conventional photographic additives which can be used in the present invention are also described in the above three *Research Disclosure* references, and described portions relating thereto are shown in the following table.

| Type of Additives | RD17643 | RD18716 | RD307105 |
|---|---|---|---|
| 1. Chemical Sensitizers | p.23 | p.648, right column | p.866 |
| 2. Sensitivity Increasing Agents | — | p.648, right column | — |
| 3. Spectral Sensitizers, Supersensitizers | p.23-24 | p.648, right column to p.649, right column | p.866–868 |
| 4. Brightening Agents | p.24 | p.647, right column | p.868 |
| 5. Antifoggants, Stabilizers | p.24–25 | p.649, right column | p.868–870 |
| 6. Light Absorbers, Filter dyes, UV Absorbers | p.25–26 | p.649, right column to p.650, left column | p.873 |
| 7. Stain Inhibitors | p.25, right column | p.650, left to right columns | p.872 |
| 8. Dye Image Stabilizers | p.25 | p.650, left column | p.872 |
| 9. Hardeners | p.26 | p.651, left column | p.874–875 |
| 10. Binders | p.26 | p.651, left column | p.873–874 |
| 11. Plasticizers, Lubricants | p.27 | p.650, right column | p.876 |
| 12. Coating Aids, Surfactants | p.26–27 | p.650, right column | p.875–876 |
| 13. Antistatic Agents | p.27 | p.650, right column | p.876–877 |
| 14. Mat Finishing Agents | — | — | p.878–879 |

In order to prevent the photographic properties from deteriorating due to a formaldehyde gas, compounds described in U.S. Pat. Nos. 4,411,987 and 4,435,503 which can react with formaldehyde to fix thereof are preferably added to the photographic materials.

It is preferred that mercapto compounds described in U.S. Pat. Nos. 4,740,454 and 4,788,132, JP-A-62-18539 and JP-A-1-283551 are added to the photographic materials of the present invention.

It is also preferred that the photographic materials of the present invention contain compounds described in JP-A-1-106052 which release fogging agents, development accelerators, solvents for silver halides or precursors thereof, regardless of the amount of silver produced developing process.

The photographic materials preferably contain dyes dispersed by methods described in PCT International Publication No. W088/04794 and JP-A-1-502912 or dyes described in EP-A-317,308, U.S. Pat. No. 4,420,555 and JP-A-1-259358.

Various color couplers can be used in the photographic materials of the present invention. Examples thereof are described in the patents cited in *Research Disclosure*, No. 17643, VII-C to G and ibid. No. 307105, VII-C to G described above.

Preferred examples of yellow couplers are described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and European Patent 249,473A.

As magenta couplers, 5-pyrazolone compounds and pyrazoloazole compounds are preferably used. Particularly preferred examples thereof are described in U.S. Pat. Nos. 4,310,619 and 4,351,897, European Patent 73,636, U.S. Pat. Nos. 3,061,432 and 3,725,064, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and PCT International Publication No. W088/04795.

Cyan couplers include phenol couplers and naphthol couplers. Preferred examples thereof are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658. Further, pyrazoloazole couplers described in JP-A-64-553, JP-A-64-554, JP-A-64-555 and JP-A-66-556 and imidazole couplers described in U.S. Pat. No. 4,818,672 can also be used.

Typical examples of dye-forming polymer couplers are described in U.S. Pat. Nos. 3,451,820, 4,080,211, 4,367,282, 4,409,320 and 4,576,910, British Patent 2,102,137 and European Patent 341,188A.

Preferred examples of couplers whose forming dyes have appropriate diffusibility include those described in U.S. Pat. No. 4,366,237, British Patent 2,125,570, European Patent 96,570 and West German Patent (OLS) 3,234,533.

Preferred colored couplers for correcting unnecessary absorption of forming dyes are described in *Research Disclosure*, No. 17643, Item VII-G, ibid. 307105, Item VII-G, U.S. Pat. No. 4,163,670, JP-B-57-39413, U.S. Pat. Nos. 4,004,929 and 4,138,258 and British Patent 1,146,368. It is also preferred to use couplers for correcting unnecessary absorption of forming dyes with fluorescent dyes released on coupling, and to use couplers having dye precursor groups as eliminable groups which can react with developing agents to form dyes. The former couplers are described in U.S. Pat. No. 4,774,181 and the latter couplers are described in U.S. Pat. No. 4,777,120.

Couplers which release photographically useful residues on coupling can also be preferably used in the present invention. Preferred DIR couplers which release development restrainers are described in the patents cited in *Research Disclosure*, No. 17643, Item VII-F and ibid,, No. 307105, Item VII-F described above, JP-A-57-151944, JP-A-57-154234, JP-A-60-184248, JP-A-63-37346, JP-A-63-37350 and U.S. Pat. Nos. 4,248,962 and 4,782,012.

Bleaching promoter releasing couplers described in *Research Disclosure*, No. 11449, ibid., No. 24241 and JP-A-61-201247 are effective to reduce the time required for processing stages having bleaching ability, and particularly effective when they are added to the photographic materials containing the tabular silver halide grains described above. Preferred couplers which release nucleating agents or development accelerators in image-like form on development are described in British Patents 2,097,140 and 2,131,188, JP-A-59-157638 and JP-A-59-170840. Further, preferred couplers which release fogging agents, development accelerators, solvents for silver halides and the like by oxidation-reduction reaction with oxidation products of developing agents are described in JP-A-60-107029, JP-A-60-252340, JP-A-1-44940 and JP-A-1-45687.

Other compounds which can be used in the present invention include competitive couplers described in U.S. Pat. No. 4,130,427, multiequivalent couplers described in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described in JP-A-60-185950 and JP-A-62-24252, couplers which release dyes recoloring after elimination described in European Patents 173,302A and 313308A, ligand releasing couplers described in U.S. Pat. No. 4,553,477, leuco dye releasing couplers described in JP-A-63-75747 and fluorescent dye releasing couplers described in U.S. Pat. No. 4,774,181.

The couplers used in the present invention can be incorporated in the photographic materials by various conventional dispersing methods.

Examples of high boiling solvents used in oil-in-water dispersion methods are described in U.S. Pat. No. 2,322,027. Examples of the high boiling solvents having a boiling point of 175° C. or more at atmospheric pressure which are used in the oil-in-water dispersion methods include phthalates [for example, dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl)phthalate], phosphates or phosphonates (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoates (for example, 2-ethylhexyl benzoate, dodecyl benzoate and 2-ethylhexyl p-hydroxybenzoate, amides (for examples, N,N-diethyldodecaneamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl) sebacate, dioctyl azelate, glycerol tributyrate, isostearyl lactate and trioctyl citrate), aniline derivatives (for example, N,N-dibutyl-2-butoxy-5-tert-octylaniline), and hydrocarbons (for example, paraffin, dodecylbenzene and diisopropylnaphthalene). Organic solvents having a boiling point of about 30° C. or more and preferably about 50° C.

to about 160° C. may be used as supplementary solvents. Typical examples thereof include ethyl acetate, butyl acetate, ethyl propionate, methyl ethyl ketone, cyclohexanone, 2-ethoxyethyl acetate and dimethylformamide.

The stages and effects of latex dispersion methods and examples of latexes for impregnation are described in U.S. Pat. No. 4,199,363, West German Patents (OLS) 2,541,274 and 2,541,230.

It is preferred that the photographic materials of the present invention contain various preservatives or antifungal agents such as 1,2-benzisothiazoline-3-one, n-butyl p-hydroxybenzoate, phenol, 4-chloro-3,5-dimethylphenol, 2-phenoxyethanol and 2-(4-thiazolyl)benzimidazole described in JP-A-63-257747, JP-A-62-272248 and JP-A-1-80941 and phenetyl alcohol.

Appropriate supports which can be used in the photographic materials of the present invention are described, for example, in *Research Disclosure*, No. 17643, page 28, ibid., No. 18716, page 647, right column to page 648, left column, and ibid., No. 307105, page 879.

Various plastic films described in JP-A-4-124636, page 5, upper right column, line 1 to page 6, upper right column, line 5 can be used as materials for supports. Preferred examples thereof include cellulose derivatives (for example, diacetylacetate, triacetylacetate, propionylacetate, butanoylacetate and acetylpropionylacetate), and polyesters (for example, polyethylene terephthalate, poly-1,4-cyclohexanedimethylene terephthalate and polyethylene naphthalate) described in JP-B-48-40414.

It is preferred that these supports are biaxially stretched, followed by heat fixing, and may be subjected to heat relaxation, if necessary. Further, it is preferred that these supports are previously heat treated at a temperature of Tg (glass transition temperature) or less to reduce their curling tendency. For example, in the case of polyethylene terephthalate, Tg is about 120° C., so that it is preferably heat treated at a temperature of 190° C. or lower for 0.2 to 48 hours, and more preferably at a temperature of 115° C. for 24 hours. In particular, it is preferred because of increased efficiency that the temperature is once elevated to Tg or higher and gradually lowered to near Tg for heat treatment for a short period of time. In the case of polyethylene naphthalate, the temperature is once kept at 130° to 200° C., and then lowered to 125° C., followed by gradually cooling to 100° C. for 40 minutes, whereby heat treating time can be significantly shortened.

For the film supports used in the present invention, polyethylene terephthalate and polyethylene naphthalate described in *Kinoh Zairyo* (*Functional Materials*), pages 20 to 28, February 1991 (CMC) are preferred, because higher effect can be obtained under the constitution of the present invention. The thickness of the supports used in the photographic materials of the present invention is preferably 70 to 130 μm, and more preferably 80 to 120 μm.

When the photographic material of the present invention are used as a color film, it is preferred that the support has a magnetic recording layer described in PCT International Publication No. WO90/04205, FIG. 1A. Such a support having the magnetic recording layer preferably has a conductive layer containing zinc, titanium, tin, etc. on one side thereof as described in JP-A-4-62543. Further, the support having a striped magnetic recording layer and a transparent magnetic recording layer adjacent thereto described in JP-A-4-124628 can also be used. The magnetic recording layer can also be provided with the protective layer described in JP-A-4-73737.

Cartridges (patrone) for containing the photographic materials of the present invention may be any of used at present or known in the art. Particularly preferred examples thereof include cartridges having shapes described in U.S. Pat. No. 4,834,306, FIGS. 1 to 3, and in U.S. Pat. No. 4,846,418, FIGS. 1 to 3.

With respect to formats of the films used in the present invention, any known formats including Type 135 provided by the Japanese Industrial Standards (JIS, K-7519 (1982)) can be used, in addition to formats described in JP-A-4-287040.

The present invention will be further illustrated in greater detail with reference to the following examples, which are, however, not to be construed as limiting the invention.

EXAMPLE 1

A cellulose triacetate support having a subbing layer was coated with multiple layers having the following composition to prepare sample 101 of a multilayer color photographic material.

(Light-Sensitive Layer Composition)

Materials used in the respective layers are classified as follows:

| | |
|---|---|
| ExC: Cyan Coupler | UV: Ultraviolet Absorber |
| ExM: Magenta Coupler | HBS: High Boiling Organic Solvent |
| ExY: Yellow Coupler | H: Gelatin hardener for Gelatin |
| ExS: Sensitizing Dye | |

Numerals corresponding to respective components indicate a coated amount in g/m$^2$ unit. For silver halides, numerals indicate a coated amount as silver. However, for sensitizing dyes, numerals indicate a coated amount in mol per mol of silver halide contained in the same layer.

(Sample 101)

| | |
|---|---|
| **First Layer (Antihalation Layer)** | |
| Black Colloidal Silver | Silver 0.18 |
| Gelatin | 1.40 |
| ExM-1 | 0.11 |
| ExF-1 | $3.4 \times 10^{-3}$ |
| HBS-1 | 0.16 |
| **Second Layer (Intermediate Layer)** | |
| ExC-2 | 0.030 |
| UV-1 | 0.020 |
| UV-2 | 0.020 |
| UV-3 | 0.060 |
| HBS-1 | 0.05 |
| HBS-2 | 0.020 |
| Polyethyl Acrylate Latex | 0.080 |
| Gelatin | 0.90 |
| **Third Layer (Low Sensitivity Red-Sensitive Emulsion Layer)** | |
| Emulsion A | Silver 0.23 |
| Emulsion B | Silver 0.23 |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.050 |
| ExC-3 | 0.030 |
| ExC-4 | 0.14 |
| ExC-5 | $3.0 \times 10^{-3}$ |
| ExC-7 | $1.0 \times 10^{-3}$ |
| ExC-8 | 0.010 |
| Cpd-2 | 0.005 |
| HBS-1 | 0.10 |
| Gelatin | 0.90 |

-continued

| Fourth Layer (Medium Sensitivity Red-Sensitive Emulsion Layer) | |
|---|---|
| Emulsion C | Silver 0.70 |
| ExS-1 | $3.4 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.050 |
| ExC-5 | 0.010 |
| ExC-8 | 0.010 |
| Cpd-2 | 0.023 |
| HBS-1 | 0.11 |
| Gelatin | 0.60 |
| **Fifth Layer (High Sensitivity Red-Sensitive Emulsion Layer)** | |
| Emulsion D | Silver 1.62 |
| ExS-1 | $2.4 \times 10^{-4}$ |
| ExS-2 | $1.0 \times 10^{-5}$ |
| ExS-3 | $3.0 \times 10^{-4}$ |
| ExC-1 | 0.10 |
| ExC-3 | 0.050 |
| ExC-5 | $2.0 \times 10^{-3}$ |
| ExC-6 | 0.010 |
| ExC-8 | 0.010 |
| Cpd-2 | 0.025 |
| HBS-1 | 0.20 |
| HBS-2 | 0.10 |
| Gelatin | 1.30 |
| **Sixth Laver (Intermediate Layer)** | |
| Cpd-1 | 0.090 |
| HBS-1 | 0.05 |
| Polyethyl Acrylate Latex | 0.15 |
| Gelatin | 1.10 |
| **Seventh Layer (Low Sensitivity Green-Sensitive Emulsion Layer)** | |
| Emulsion E | Silver 0.24 |
| Emulsion F | Silver 0.24 |
| ExS-4 | 4.0 × 10-5 |
| ExS-5 | $1.8 \times 10^{-4}$ |
| ExS-6 | $6.5 \times 10^{-4}$ |
| ExM-1 | $5.0 \times 10^{-3}$ |
| ExM-2 | 0.28 |
| ExM-3 | 0.086 |
| ExM-4 | 0.030 |
| ExY-1 | 0.015 |
| HBS-1 | 0.30 |
| HBS-3 | 0.010 |
| Gelatin | 0.85 |
| **Eighth Layer (Medium Sensitivity Green-Sensitive Emulsion Layer)** | |
| Emulsion G | Silver 0.94 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.14 |
| ExM-3 | 0.045 |
| ExM-5 | 0.020 |
| ExY-1 | $7.0 \times 10^{-3}$ |
| ExY-4 | $2.0 \times 10^{-3}$ |
| ExY-5 | 0.020 |
| HBS-1 | 0.16 |
| HBS-3 | $8.0 \times 10^{-3}$ |
| Gelatin | 0.80 |
| **Ninth Layer (Medium Sensitivity Green-Sensitive Emulsion Layer)** | |
| Emulsion H | Silver 1.29 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.050 |
| ExM-5 | 0.020 |
| ExY-4 | $5.0 \times 10^{-3}$ |
| Cpd-3 | 0.050 |
| HBS-1 | 0.20 |
| HBS-2 | 0.08 |

-continued

| | |
|---|---|
| Polyethyl Acrylate Latex | 0.26 |
| Gelatin | 1.45 |
| **Tenth Layer (Yellow Filter Layer)** | |
| Yellow Colloidal Silver | Silver $7.5 \times 10^{-3}$ |
| Cpd-1 | 0.13 |
| Cpd-4 | $7.5 \times 10^{-3}$ |
| HBS-1 | 0.60 |
| Gelatin | 0.60 |
| **Eleventh Layer (Low Sensitivity Blue-Sensitive Emulsion Layer)** | |
| Emulsion I | Silver 0.25 |
| Emulsion J | Silver 0.25 |
| Emulsion K | Silver 0.10 |
| ExS-7 | $8.0 \times 10^{-4}$ |
| ExC-7 | 0.010 |
| ExY-1 | $5.0 \times 10^{-3}$ |
| ExY-2 | 0.40 |
| ExY-3 | 0.45 |
| ExY-4 | $6.0 \times 10^{-3}$ |
| ExY-6 | 0.10 |
| HBS-1 | 0.30 |
| Gelatin | 1.65 |
| **Twelfth Layer (High Sensitivity Blue-Sensitive Emulsion Layer)** | |
| Emulsion L | Silver 1.30 |
| ExS-7 | $3.0 \times 10^{-4}$ |
| ExY-2 | 0.15 |
| ExY-3 | 0.06 |
| ExY-4 | $5.0 \times 10^{-3}$ |
| Cpd-2 | 0.10 |
| HBS-1 | 0.070 |
| Gelatin | 1.20 |
| **Thirteenth Layer (First Protective Layer)** | |
| UV-2 | 0.10 |
| UV-3 | 0.12 |
| UV-4 | 0.30 |
| HBS-1 | 0.10 |
| Gelatin | 2.50 |
| **Fourteenth Layer (Second Protective Layer)** | |
| Emulsion M | Silver 0.10 |
| H-1 | 0.37 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In addition, the respective layers appropriately contain any of W-1 to W-3, B-4 to B-6, F-1 to F-17, iron salts, lead salts, gold salts, platinum salts, iridium salts, palladium salts and rhodium salts to improve keeping quality, processability, pressure resistance, mold proofing, bacteria proofing, anti-static quality and coating quality.

Cpd-4 was dispersed in solid form in accordance with the method described in PCT International Publication No. 88-4794.

TABLE 1

| Emulsion | Grain Shape (Halogen Structure) | Average AgI Content (%) | Coefficient of Variation in Iodine Distribution of Grains (%) | Diameter Corresponding to Average Grain Size (μm) | Coefficient of Variation in Grain Size (%) | Diameter/ Thickness Ratio |
|---|---|---|---|---|---|---|
| A | Circular tabular (uniform structure) | 0 | — | 0.45 | 15 | 5.5 |
| B | Cubic (shell: high iodine double structure) | 1.0 | — | 0.20 | 8 | 1 |
| C | Tetradecahedral (intermediate shell: high iodine triple structure) | 4.5 | 25 | 0.85 | 18 | 1 |
| D | Hexahedral tabular (outer shell: high iodine structure) | 2.0 | 16 | 1.10 | 17 | 7.5 |
| E | Circular Tabular (outer shell: high iodine structure) | 1.0 | — | 0.45 | 15 | 3.0 |
| F | Octahedral (core: high iodine double structure | 6.0 | 22 | 0.25 | 8 | 1 |
| G | Tatradecahedral (intermediate shell: high iodine triple structure) | 4.5 | 19 | 0.85 | 19 | 1 |
| H | Hexahedral tabular (outer shell: high iodine structure) | 3.5 | 16 | 1.10 | 16 | 6.8 |
| I | Circular Tabular (center part: high iodine structure) | 2.0 | 15 | 0.45 | 15 | 6.0 |
| J | Cubic (uniform structure) | 1.0 | 10 | 0.30 | 8 | 1 |
| K | Tetradecahedral (core: high iodine double structure) | 18.0 | 8 | 0.80 | 18 | 1 |
| L | Hexahedral tabular (intermediate shell: high iodine structure) | 12.0 | 12 | 1.35 | 22 | 12.0 |
| M | Fine insensitive grains (uniform structure) | 1.0 | — | 0.04 | 15 | 1 |

In Table 1, (1) emulsions I to L were subjected to reduction sensitization by use of thiourea dioxide and thiosulfonic acid in preparing grains according to the Examples of JP-A-2-191938; (2) emulsions A to L were subjected to gold sensitization, sulfur sensitization and selenium sensitization in the presence of the spectrally sensitizing dyes described for the respective light-sensitive layers and sodium thiocyanate according to the examples of JP-A-3-237450; (3) low molecular weight gelatin was used for the preparation of the tabular grains according to the Examples of JP-A-1-158426; and (4) dislocation lines as described in JP-A-3-237450 were observed under a high-voltage electron microscope in the tabular grains.

Couplers and additives used in the respective layers were dispersed in gelatin solutions by processes shown in Table 2. Processes for dispersing them for the respective layers are shown in Table 3.

TABLE 2

| | Dispersing Process |
|---|---|
| A | A homogeneous aqueous solution of couplers, high boiling solvents, surfactants, NaOH, n-propanol and other additives is neutralized for precipitation and dispersion. |
| B | A homogeneous n-propanol solution of couplers, high boiling solvents and other additives is added to an aqueous solution of surfactants for precipitation and dispersion. |

TABLE 2-continued

| | Dispersing Process |
|---|---|
| C | A solution of couplers, high boiling solvents, surfactants, low boiling solvents and other additives is mixed with an aqueous solution of gelatin and surfactants, followed by stirring and emulsifying for dispersion, and the low boiling solvents are removed by evaporation. |
| D | In process C, the organic solvents are removed by washing with water or ultrafiltration after dispersion. |

TABLE 3

| Layer | Dispersing Process | Average Size of Dispersed Grains (nm) |
|---|---|---|
| Third layer | C | 133 |
| Fourth layer | C | 130 |
| Fifth layer | D | 40 |
| Seventh layer | C | 135 |
| Eighth layer | C | 60 |
| Ninth layer | A | 40 |
| Eleventh layer | C | 125 |
| Twelfth layer | B | 80 |

ExC-1
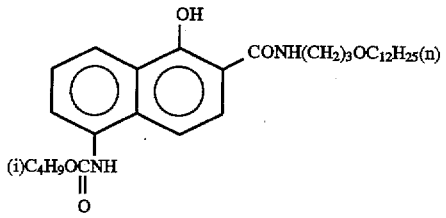
ExC-2
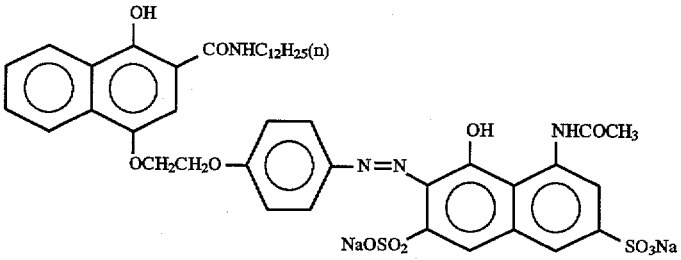
ExC-3
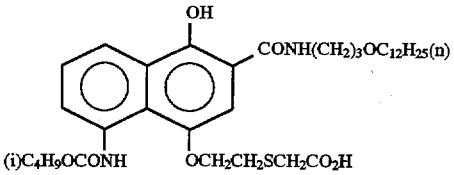
ExC-4
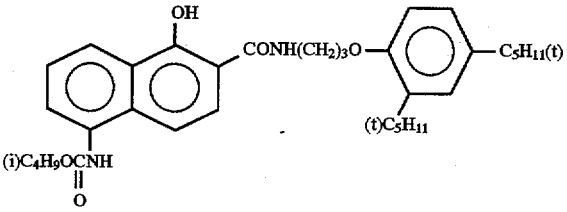
ExC-5
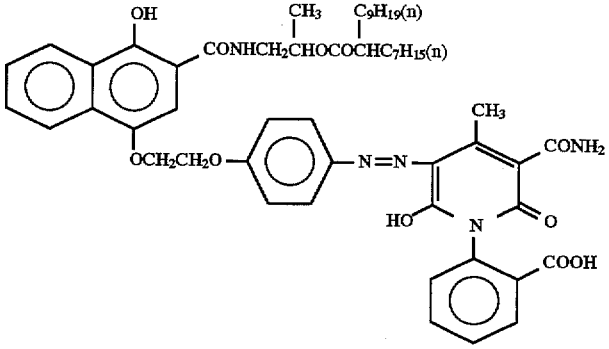
ExC-6
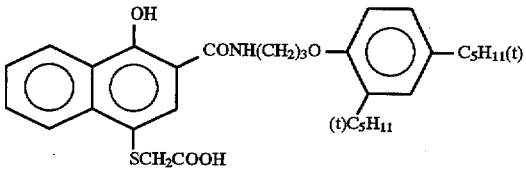

-continued
ExC-7
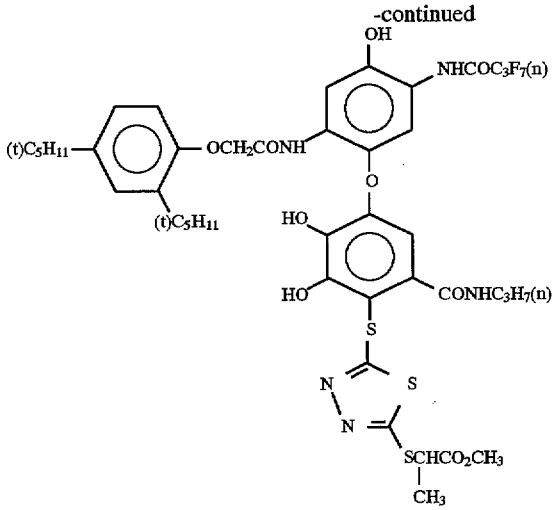
ExC-8
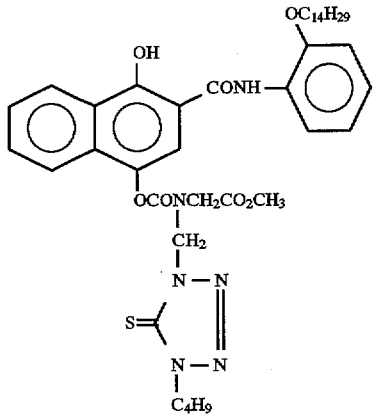
ExM-1
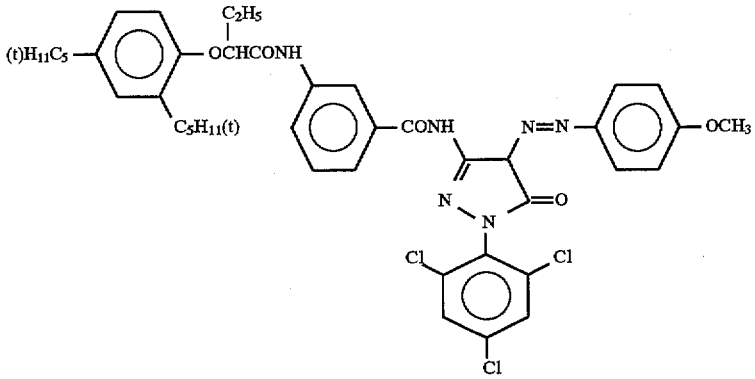
ExM-2
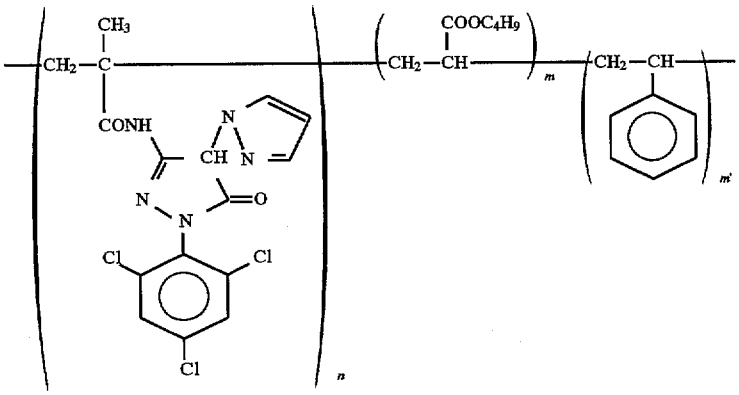

-continued
ExM-3
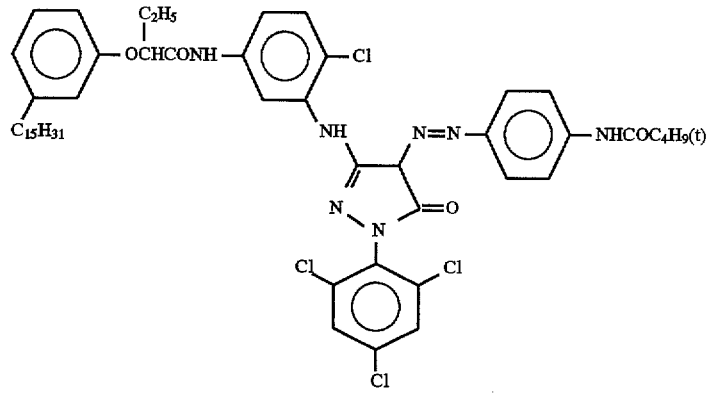
ExM-4
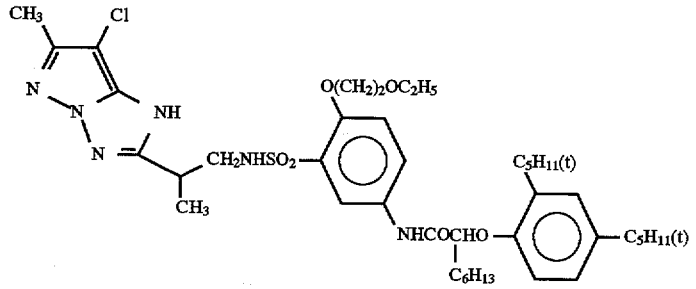
ExM-5
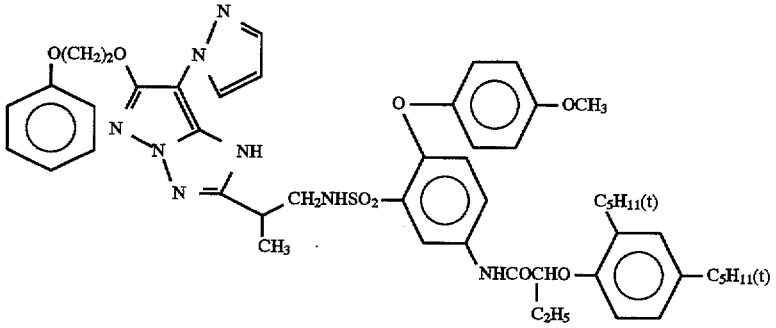
ExY-1
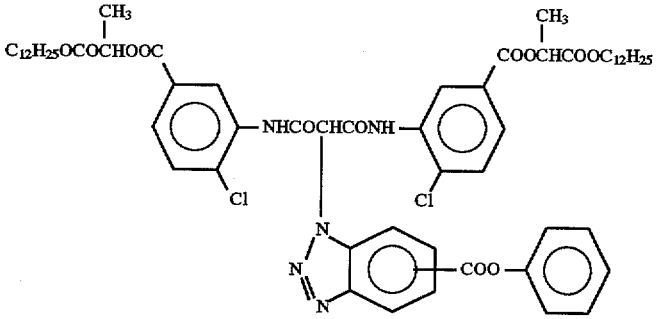
ExY-2
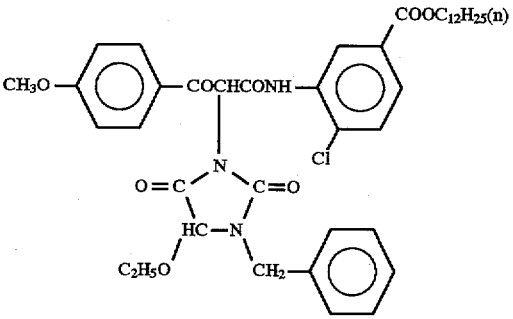

-continued
ExY-3
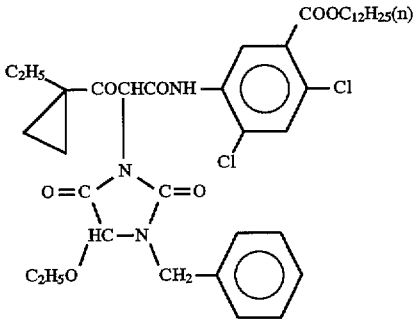
ExY-4
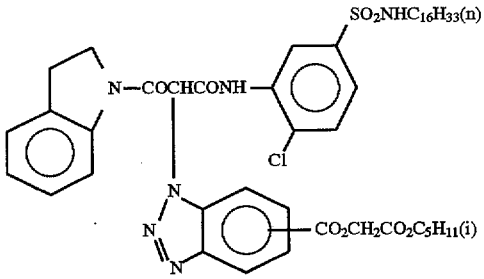
ExY-5
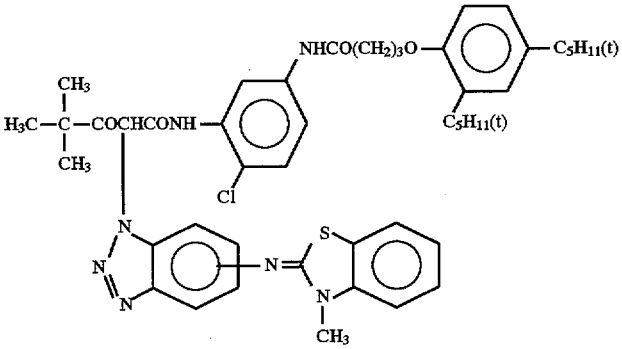
ExY-6
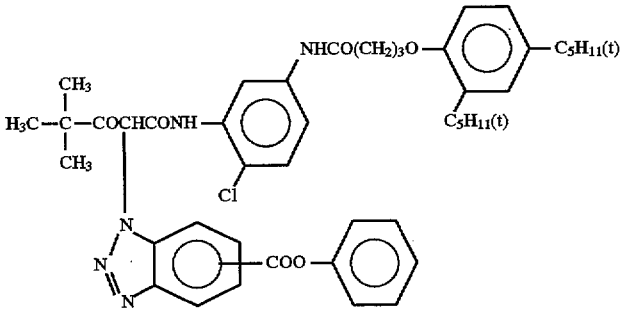
ExF-1
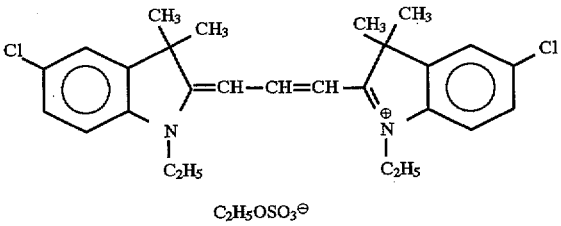

-continued
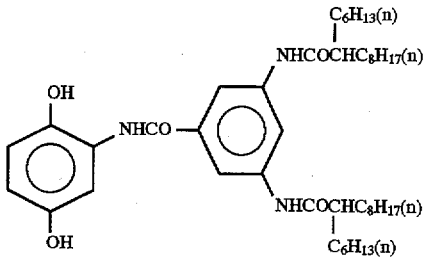
Cpd-1
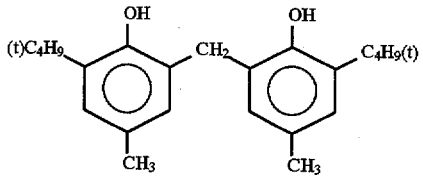
Cpd-2
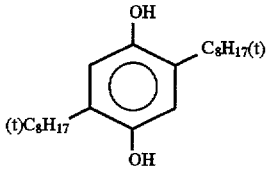
Cpd-3
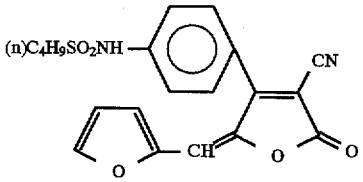
Cpd-4
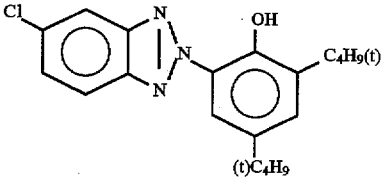
UV-1
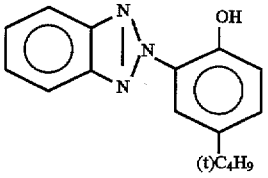
UV-2
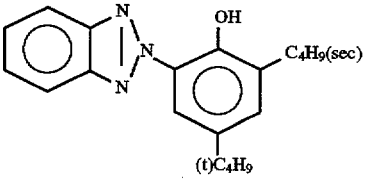
UV-3
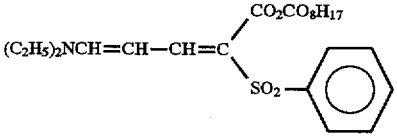
UV-4
Tricresyl Phosphate HBS-1
Di-n-butyl Phthalate HBS-2

-continued
HBS-3
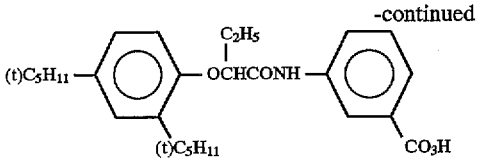
ExS-1
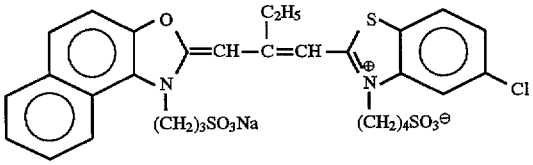
ExS-2
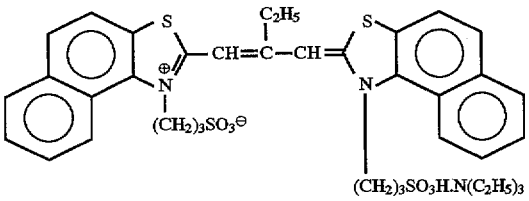
ExS-3
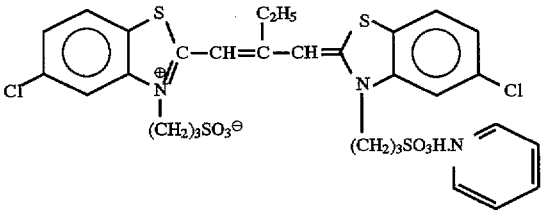
ExS-4
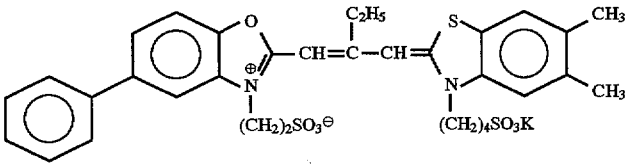
ExS-5
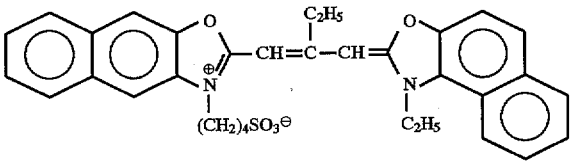
ExS-6
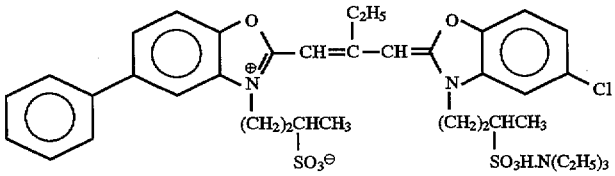
ExS-7
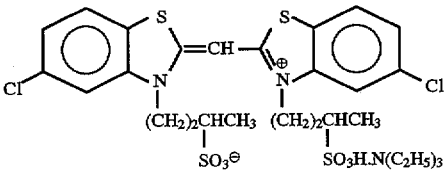
S-1
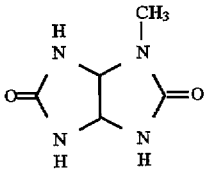

-continued
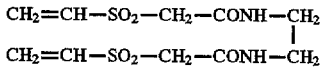
H-1
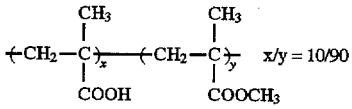
B-1
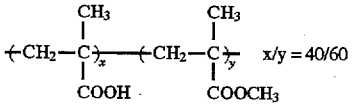
B-2
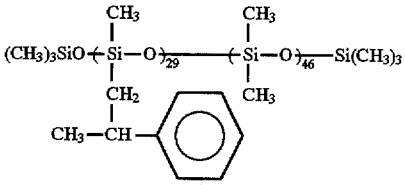
B-3
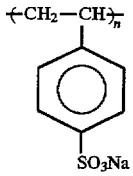
B-4
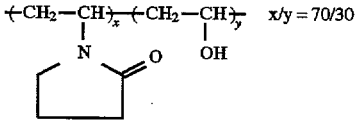
B-5
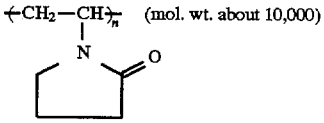
B-6
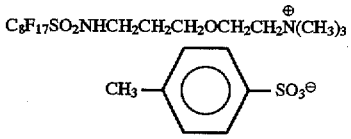
W-1
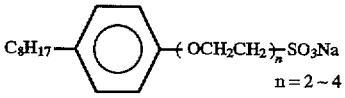
W-2
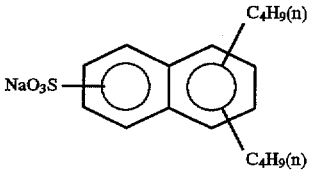
W-3
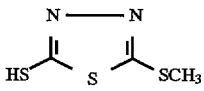
F-1

-continued
F-2
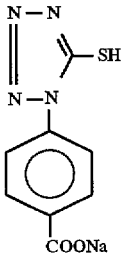
F-3
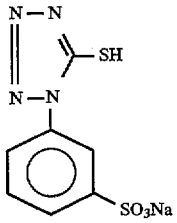
F-4
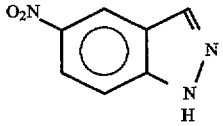
F-5
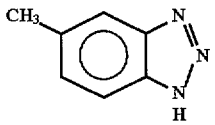
F-6
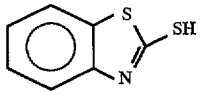
F-7
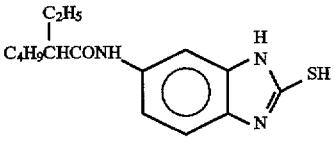
F-8
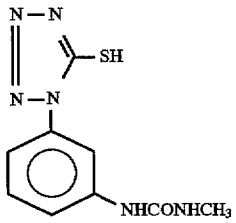
F-9
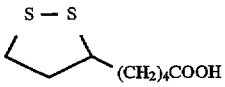
F-10
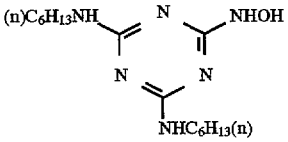
F-11
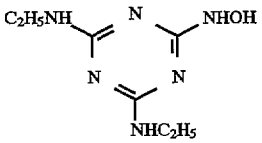

-continued

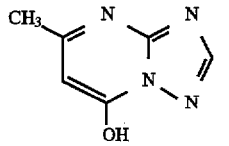

F-12

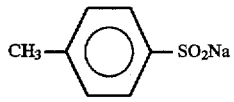

F-13

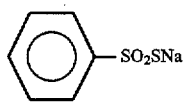

F-14

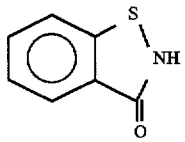

F-15

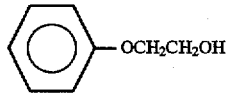

F-16

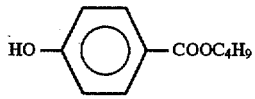

F-17

Samples 101A to 101D were prepared in the same manner as of Sample 101, except that an amount of gelatin applied to the samples was changed to vary the film thickness. The film thickness is shown in Table 4.

Samples 101A to 101D, thus prepared, were slitted to a width of 35 mm and processed, followed by imagewise exposure. Then, each sample was continuously processed (until the accumulative replenishment rate of a fixing solution reached 3 times tank capacity thereof) in the following processes by use of an automatic processor.

For the fixing solution, the content of ammonium sulfite, sodium sulfite, ammonium thiosulfate and sodium thiosulfate was changed to vary ratio of ammonium ions to all cations as described in Table 4.

| Stage | Processing Time | Processing Temperature (°C.) | Replenishment Rate (ml/m$^2$) | Tank Capacity (liter) |
|---|---|---|---|---|
| Color Development | 3 min and 15 sec | 38 | 620 | 20 |
| Bleaching | 3 min | 38 | 700 | 40 |
| Washing (1) | 15 sec | 24 | countercurrent flow from (2) to (1) | 10 |
| Washing (2) | 15 sec | 24 | 420 | 10 |
| Fixing | 3 min | 38 | 420 | 30 |
| Washing (3) | 30 sec | 24 | countercurrent flow from (4) to (3) | 10 |
| Washing (4) | 30 sec | 24 | 34000 | 10 |
| Stabilization | 30 sec | 38 | 560 | 10 |
| Drying | 4 min and 20 sec | 55 | | |

The composition of the processing solutions used is shown below:

| Color Developing Solution | Tank Solution (g) | Replenisher (g) |
|---|---|---|
| Diethylenetriaminepentaacetic Acid | 1.0 | 1.0 |
| 1-Hydroxyethylidene-1,1-diphosphonic Acid | 2.0 | 2.2 |
| Sodium Sulfite | 4.0 | 4.8 |
| Potassium Carbonate | 30.0 | 39.0 |
| Potassium Bromide | 1.4 | 0.3 |
| Potassium Iodide | 1.5 mg | - |
| Hydroxylamine Sulfate | 2.4 | 3.1 |
| 4-(N-Ethyl-N-β-hydroxyethylamino)-2-methylaniline Sulfate | 4.5 | 6.0 |
| Water to make | 1.0 liter | 1.0 liter |
| pH (adjusted with potassium hydroxide and sulfuric acid) | 10.05 | 10.15 |

| Bleaching Solution | Tank Solution (g) | Replenisher (g) |
|---|---|---|
| Sodium Ferric Ethylenediaminetetraacetate.Trihydrate | 100.0 | 120.0 |
| Disodium Ethylenediaminetetraacetate | 10.0 | 11.0 |
| 3-Mercapto-1,2,4-triazole | 0.03 | 0.08 |
| Ammonium Bromide | 140.0 | 160.0 |
| Ammonium Nitrate | 30.0 | 35.0 |
| Aqueous Ammonia (27%) | 6.5 ml | 4.0 ml |
| Water to make | 1.0 liter | 1.0 liter |
| pH (adjusted with aqueous ammonia and nitric acid) | 6.0 | 5.7 |

| Fixing Solution | Tank Solution (g) | Replenisher (g) |
|---|---|---|
| Ethylenediaminetetraacetic Acid | 0.5 | 0.7 |
| Ammonium Sulfite or Sodium Sulfite | 0.14 mol | 0.15 mol |
| Ammonium Thiosulfate or Sodium Thiosulfate | 1.4 mol | 1.5 mol |

-continued

| | | |
|---|---|---|
| Thioether Compound (FA-3) | Refer to Tables 4 and 5 | |
| Acetic Acid (90%) | 3.3 | 4.0 |
| Water to make | 1.0 liter | 1.0 liter |
| pH (adjusted with aqueous ammonia and acetic acid) | 6.7 | 6.8 |

| Stabilizing Solution | Tank Solution/Replenisher (g) |
|---|---|
| p-Nonylphenoxy Polyglycidol (average degree of polymerization of glycidol: 10) | 0.2 |
| Ethylenediaminetetraacetic Acid | 0.05 |
| 1,2,4-Triazole | 1.3 |
| 1,4-Bis(1,2,4-triazole-1-ylmethyl)-piperazine | 0.75 |
| Hydroxyethyl Cellulose (HEC SP-2000, Daicel Ltd.) | 0.1 |
| 1,2-Benzisothiazoline-3-one | 0.05 |
| Water to make | 1.0 liter |
| pH | 8.5 |

tions of 80° C. and 70% RH for 2 weeks. Before and after the elapse of time, the yellow density of the photographic material was measured with an X-ray 310 type photographic densitometer, and ΔDmin was calculated by the following equation:

$$\Delta Dmin = D_2 - D_1$$

$D_1$=The density of a photographic material before an elapse of time at 80° C./70% RH $D_2$=The density of a photographic material after an elapse of 2 weeks at 80° C./70% RH

TABLE 4

| Test No. | Sample No. | Film Thickness (μm) | Ammonium Ratio in Fixing Solution (mol %) | Concentration of Thioether Compound (mol/liter) | Amount of Residual Silver (μg/m²) | ΔDmin | Remarks |
|---|---|---|---|---|---|---|---|
| 1-1 | 101A | 25.0 | 100 | 0 | 3.6 | 0.03 | Comparison |
| 1-2 | 101B | 21.9 | 100 | 0 | 3.5 | 0.03 | Comparison |
| 1-3 | 101C | 16.8 | 100 | 0 | 3.4 | 0.03 | Comparison |
| 1-4 | 101D | 14.0 | 100 | 0 | 3.3 | 0.03 | Comparison |
| 1-5 | 101A | 25.0 | 100 | 0.01 | 3.5 | 0.03 | Comparison |
| 1-6 | 101B | 21.9 | 100 | 0.01 | 3.4 | 0.03 | Comparison |
| 1-7 | 101C | 16.8 | 100 | 0.01 | 3.3 | 0.03 | Comparison |
| 1-8 | 101D | 14.0 | 100 | 0.01 | 3.2 | 0.03 | Comparison |
| 1-9 | 101A | 25.0 | 50 | 0 | 7.6 | 0.06 | Comparison |
| 1-10 | 101B | 21.9 | 50 | 0 | 7.5 | 0.06 | Comparison |
| 1-11 | 101C | 16.8 | 50 | 0 | 7.4 | 0.06 | Comparison |
| 1-12 | 101D | 14.0 | 50 | 0 | 7.3 | 0.06 | Comparison |
| 1-13 | 101A | 25.0 | 50 | 0.01 | 7.5 | 0.06 | Comparison |
| 1-14 | 101B | 21.9 | 50 | 0.01 | 3.7 | 0.03 | Invention |
| 1-15 | 101C | 16.8 | 50 | 0.01 | 3.4 | 0.03 | Invention |
| 1-16 | 101D | 14.0 | 50 | 0.01 | 3.2 | 0.03 | Invention |
| 1-17 | 101A | 25.0 | 0 | 0 | 10.2 | 0.08 | Comparison |
| 1-18 | 101B | 21.9 | 0 | 0 | 10.1 | 0.08 | Comparison |
| 1-19 | 101C | 16.8 | 0 | 0 | 10.0 | 0.08 | Comparison |
| 1-20 | 101D | 14.0 | 0 | 0 | 9.9 | 0.08 | Comparison |
| 1-21 | 101A | 25.0 | 0 | 0.01 | 10.2 | 0.08 | Comparison |
| 1-22 | 101B | 21.9 | 0 | 0.01 | 4.4 | 0.04 | Invention |
| 1-23 | 101C | 16.8 | 0 | 0.01 | 4.1 | 0.04 | Invention |
| 1-24 | 101D | 14.0 | 0 | 0.01 | 3.6 | 0.03 | Invention |
| 1-25 | 101A | 25.0 | 0 | 0.001 | 10.2 | 0.08 | Comparison |
| 1-26 | 101B | 21.9 | 0 | 0.001 | 4.4 | 0.04 | Invention |
| 1-27 | 101C | 16.8 | 0 | 0.001 | 4.2 | 0.04 | Invention |
| 1-28 | 101D | 14.0 | 0 | 0.001 | 3.8 | 0.03 | Invention |

(Fixing Performance Test)

Processing was conducted in the same processing stages as described above, except that a solution employed in continuous processing was used and the fixing time was 2 minutes. The amount of residual silver contained in the processed photographic material was measured by a fluorescent X-ray method.

(Image Stability Quality Test)

When continuous processing was terminated, each unexposed photographic material was processed, and the processed photographic material was preserved under condi- The results shown in Table 4 reveal that the photographic materials of the present invention are excellent in desilverization and prevention of increased stains.

EXAMPLE 2

(Preparation of Sample 102)

A 127 μm-thick cellulose triacetate support having a subbing layer was coated with respective layers having the following composition in multiple layers to prepare Sample 102, a multilayer color photographic material. Numerals indicate the amount added per m². The effect of compounds added is not limited to the purpose described.

First Layer (Antihalation Layer)

| | |
|---|---|
| Black Colloidal Silver | 0.20 g |
| Gelatin | 1.90 g |
| UV Absorber U-1 | 0.10 g |
| UV Absorber U-3 | 0.040 g |
| UV Absorber U-4 | 0.10 g |
| High Boiling Organic Solvent Oil-1 | 0.10 g |
| Fine Crystalline Solid Dispersion of Dye E-1 | 0.10 g |

Second Layer (Intermediate Layer)

| | |
|---|---|
| Gelatin | 0.40 g |
| Compound Cpd-C | 5.0 mg |
| Compound Cpd-J | 5.0 mg |
| Compound Cpd-K | 3.0 mg |
| High Boiling Organic Solvent Oil-3 | 0.10 g |
| Dye D-4 | 0.80 mg |

Third Layer (Intermediate Layer)

| | |
|---|---|
| Emulsion of Fine Silver Iodobromide Grains Whose Surfaces and Interiors Are Fogged (average grain size: 0.06 μm, coefficient of variation: 18%, AgI content: 1 mol %) | Silver 0.050 g |
| Yellow Colloidal Silver | Silver 0.030 g |
| Gelatin | 0.40 g |

Fourth Layer (Low Sensitivity Red-Sensitive Emulsion Layer)

| | |
|---|---|
| Emulsion A | Silver 0.30 g |
| Emulsion B | Silver 0.20 g |
| Gelatin | 0.80 g |
| Coupler C-1 | 0.15 g |
| Coupler C-2 | 0.050 g |
| Coupler C-3 | 0.050 g |
| Coupler C-9 | 0.050 g |
| Compound Cpd-C | 5.0 mg |
| Compound Cpd-J | 5.0 mg |
| High Boiling Organic Solvent Oil-2 | 0.10 g |
| Additive P-1 | 0.10 g |

Fifth Layer (Medium Sensitivity Red-Sensitive Emulsion Layer)

| | |
|---|---|
| Emulsion B | Silver 0.20 g |
| Emulsion C | Silver 0.30 g |
| Gelatin | 0.80 g |
| Coupler C-1 | 0.20 g |
| Coupler C-2 | 0.050 g |
| Coupler C-3 | 0.20 g |
| High Boiling Organic Solvent Oil-2 | 0.10 g |
| Additive P-1 | 0.10 g |

Sixth Layer (High Sensitivity Red-Sensitive Emulsion Layer)

| | |
|---|---|
| Emulsion D | Silver 0.40 g |
| Gelatin | 1.10 g |
| Coupler C-1 | 0.30 g |
| Coupler C-2 | 0.10 g |
| Coupler C-3 | 0.70 g |
| Additive P-1 | 0.10 g |

Seventh Layer (Intermediate Layer)

| | |
|---|---|
| Gelatin | 0.60 g |
| Additive M-1 | 0.30 g |
| Color Mixing Inhibitor Cpd-I | 2.6 mg |
| Dye D-5 | 0.020 g |
| Dye D-6 | 0.010 g |
| Compound Cpd-J | 5.0 mg |
| High Boiling Organic Solvent Oil-1 | 0.020 g |

Eighth Layer (Intermediate Layer)

| | |
|---|---|
| Emulsion of Fine Silver Iodobromide Grains Whose Surfaces and Interiors Are Fogged (average grain size: 0.06 μm, coefficient of variation: 16%, AgI content: 0.3 mol %) | Silver 0.020 g |
| Yellow Colloidal Silver | Silver 0.020 g |
| Gelatin | 1.00 g |
| Additive P-1 | 0.20 g |

-continued

| | |
|---|---|
| Color Mixing Inhibitor Cpd-A | 0.10 g |
| Compound Cpd-C | 0.10 g |

Ninth Layer (Low Sensitivity Green-Sensitive Emulsion Layer)

| | |
|---|---|
| Emulsion E | Silver 0.10 g |
| Emulsion F | Silver 0.20 g |
| Emulsion G | Silver 0.20 g |
| Gelatin | 0.50 g |
| Coupler C-4 | 0.10 g |
| Coupler C-7 | 0.050 g |
| Coupler C-8 | 0.20 g |
| Compound Cpd-B | 0.030 g |
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High Boiling Organic Solvent Oil-1 | 0.10 g |
| High Boiling Organic Solvent Oil-2 | 0.10 g |

Tenth Layer (Medium Sensitivity Green-Sensitive Emulsion Layer)

| | |
|---|---|
| Emulsion G | Silver 0.30 g |
| Emulsion H | Silver 0.10 g |
| Gelatin | 0.60 g |
| Coupler C-4 | 0.10 g |
| Coupler C-7 | 0.20 g |
| Coupler C-8 | 0.10 g |
| Compound Cpd-B | 0.030 g |
| Compound Cpd-D | 0.020 g |
| Compound Cpd-E | 0.020 g |
| Compound Cpd-F | 0.050 g |
| Compound Cpd-L | 0.050 g |
| High Boiling Organic Solvent Oil-2 | 0.010 g |

Eleventh Layer (High Sensitivity Green-Sensitive Emulsion Layer

| | |
|---|---|
| Emulsion I | Silver 0.50 g |
| Gelatin | 1.00 g |
| Coupler C-4 | 0.30 g |
| Coupler C-7 | 0.10 g |
| Coupler C-8 | 0.10 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High Boiling Organic Solvent Oil-1 | 0.020 g |
| High Boiling Organic Solvent Oil-2 | 0.020 g |

Twelfth Layer (Intermediate Layer)

| | |
|---|---|
| Gelatin | 0.60 g |
| Compound Cpd-L | 0.050 g |
| High Boiling Organic Solvent Oil-1 | 0.050 g |

Thirteenth Layer (Yellow Filter Layer

| | |
|---|---|
| Yellow Colloidal Silver | Silver 0.070 g |
| Gelatin | 1.10 g |
| Color Mixing Inhibitor Cpd-A | 0.010 g |
| Compound Cpd-L | 0.010 g |
| High Boiling Organic Solvent Oil-1 | 0.010 g |
| Fine Crystalline Solid Dispersion of Dye E-2 | 0.050 g |

Fourteenth Layer (Intermediate Layer)

| | |
|---|---|
| Gelatin | 0.60 g |

Fifteenth Layer (Low Sensitivity Blue-Sensitive Emulsion Layer)

| | |
|---|---|
| Emulsion J | Silver 0.20 g |
| Emulsion K | Silver 0.30 g |
| Gelatin | 0.80 g |
| Coupler C-5 | 0.20 g |
| Coupler C-6 | 0.10 g |
| Coupler C-10 | 0.40 g |

-continued

| Sixteenth Layer (Medium Sensitivity Blue-Sensitive Emulsion Layer) | |
|---|---|
| Emulsion L | Silver 0.30 g |
| Emulsion M | Silver 0.30 g |
| Gelatin | 0.90 g |
| Coupler C-5 | 0.10 g |
| Coupler C-6 | 0.10 g |
| Coupler C-10 | 0.60 g |
| Seventeenth Layer (High Sensitivity Blue-Sensitive Emulsion Layer) | |
| Emulsion N | Silver 0.20 g |
| Emulsion O | Silver 0.20 g |
| Gelatin | 1.20 g |
| Coupler C-5 | 0.10 g |
| Coupler C-6 | 0.10 g |
| Coupler C-10 | 0.60 g |
| High Boiling Organic Solvent Oil-2 | 0.010 g |
| Eighteenth Layer (First Protective Layer) | |
| Gelatin | 0.70 g |
| UV Absorber U-1 | 0.20 g |
| UV Absorber U-2 | 0.050 g |
| UV Absorber U-5 | 0.30 g |
| Formalin Scavenger Cpd-H | 0.40 g |
| Dye D-1 | 0.15 g |
| Dye D-2 | 0.050 g |
| Dye D-3 | 0.10 g |
| Nineteenth Layer (Second Protective Layer) | |
| Colloidal Silver | Silver 0.10 mg |
| Emulsion of Fine Silver Iodobromide Grains (average grain size: 0.06 μm, AgI content: 1 mol %) | Silver 0.10 g |
| Gelatin | 0.70 g |
| Twentieth Layer (Third Protective Layer | |
| Gelatin | 0.40 g |
| Polymethyl Methacrylate (average grain size: 1.5 μm) | 0.10 g |
| 4/6 Methyl Methacrylate/Acrylic Acid Copolymer (average grain size: 1.5 μm) | 0.10 g |
| Surfactant W-1 | 3.0 mg |
| Surfactant W-2 | 0.030 g |

In addition to the above-described compositions, additives F-1 to F-8 were added to all of the emulsion layers. Further, in addition to the above-described components, gelatin hardener H-1 and surfactants for coating and emulsification W-3, W-4, W-5 and W-6 were added to each layer.

Furthermore, phenol, 1,2-benzisothiazoline-3-one, 2-phenoxyethanol, phenetyl alcohol and butyl p-benzoate were added as preservatives and antifungal agents.

Silver iodobromide emulsions used in sample 201 were as shown in Table 5.

TABLE 5

| Name of Emulsion | Characteristics of Grains | Average Grain Size (μm) | Coefficient of Variation (%) | AgI Content (%) |
|---|---|---|---|---|
| A | Monodisperse tetradecahedral grains | 0.28 | 16 | 4.0 |
| B | Monodisperse cubic internal latent image type grains | 0.30 | 10 | 4.0 |
| C | Monodisperse cubic grains | 0.38 | 10 | 5.0 |
| D | Monodisperse tabular grains (average aspect ratio: 3.0) | 0.68 | 8 | 2.0 |
| E | Monodisperse cubic grains | 0.20 | 17 | 4.0 |

TABLE 5-continued

| Name of Emulsion | Characteristics of Grains | Average Grain Size (μm) | Coefficient of Variation (%) | AgI Content (%) |
|---|---|---|---|---|
| F | Monodisperse tetradecahedral grains | 0.25 | 16 | 4.0 |
| G | Monodisperse cubic internal latent image type grains | 0.40 | 11 | 4.0 |
| H | Monodisperse cubic grains | 0.50 | 9 | 3.5 |
| I | Monodisperse tabular grains (average aspect ratio: 5.0) | 0.80 | 10 | 2.0 |
| J | Monodisperse cubic grains | 0.30 | 18 | 4.0 |
| K | Monodisperse tetradecahedral grains | 0.45 | 17 | 4.0 |
| L | Monodisperse tabular grains (average aspect ratio: 5.0) | 0.55 | 10 | 2.0 |
| M | Monodisperse tabular grains (average aspect ratio: 8.0) | 0.70 | 13 | 2.0 |
| N | Monodisperse tabular grains (average aspect ratio: 6.0) | 1.00 | 10 | 1.5 |
| O | Monodisperse tabular grains (average aspect ratio: 9.0) | 1.20 | 15 | 1.5 |

TABLE 6

Spectral Sensitization of Emulsions A to O

| Emulsion | Sensitizing Dye | Amount Added per Mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.1 |
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

C-1
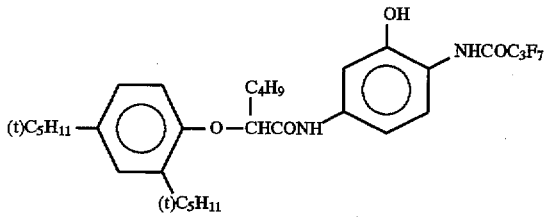
C-2
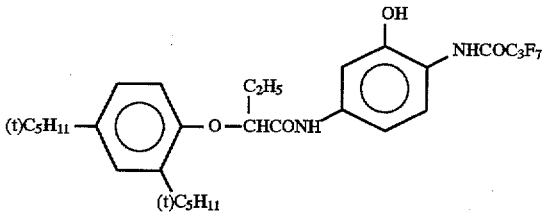
C-3
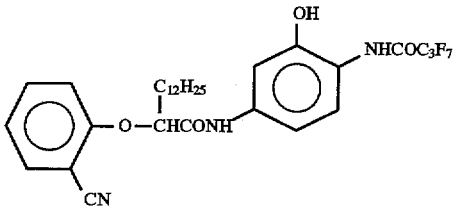
C-4
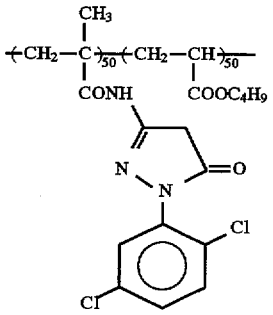
Numerals indicate wt. %
Av. mol. wt.: ca. 25,000
C-5
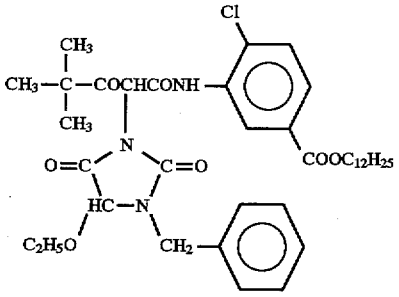
C-6
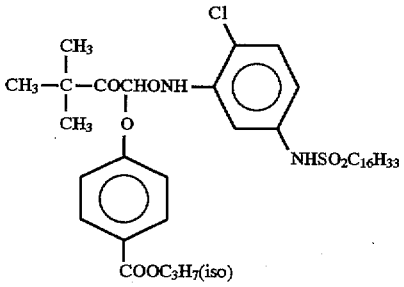

-continued
C-7
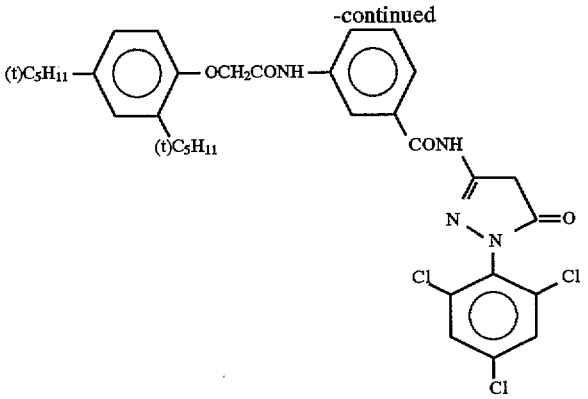
C-8
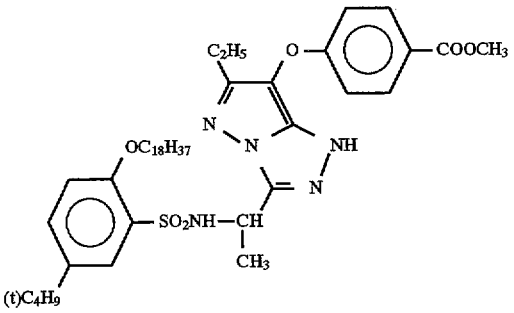
C-9
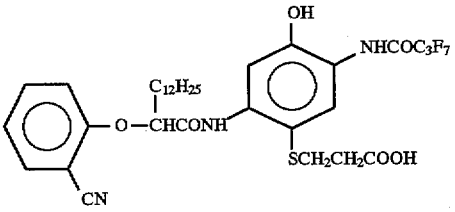
C-10
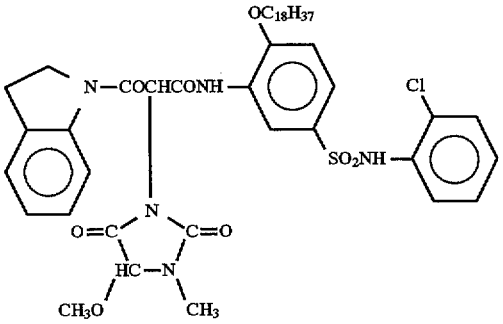
Dibutyl Phthalate — Oil-1
Tricresyl Phosphate — Oil-2
Oil-3
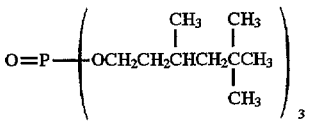
Cpd-A
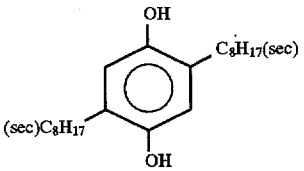

-continued
Cpd-B
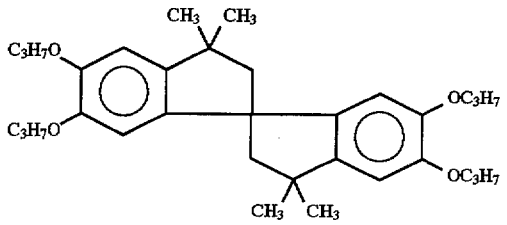
Cpd-C
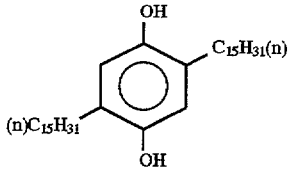
Cpd-D
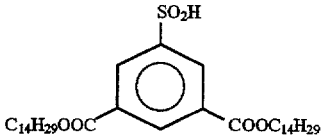
Cpd-E
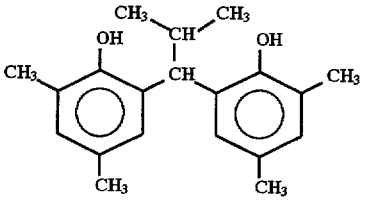
Cpd-F
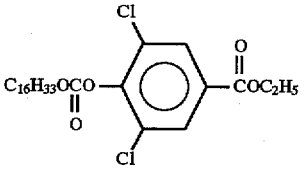
Cpd-H
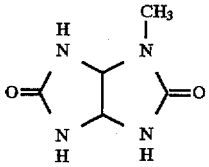
Cpd-I
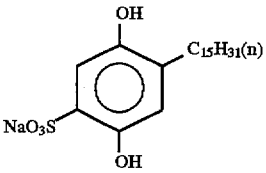
Cpd-J
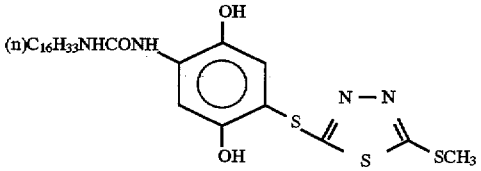

-continued
Cpd-K
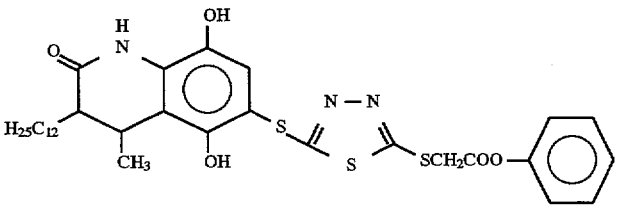
Cpd-L
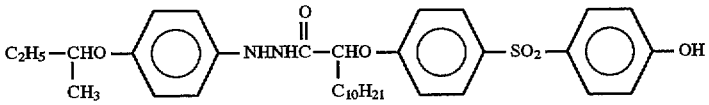
U-1
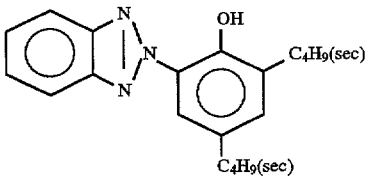
U-2
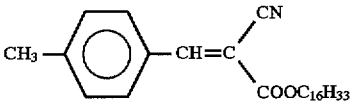
U-3
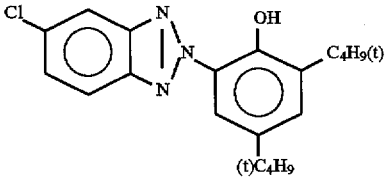
U-4
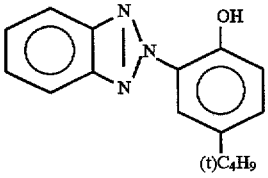
U-5
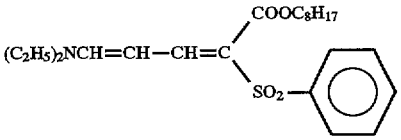
S-1
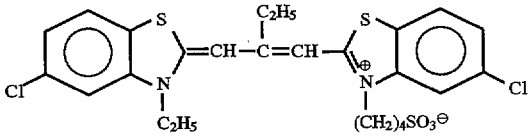
S-2
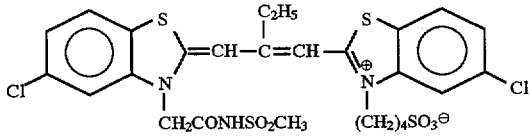

-continued
S-3
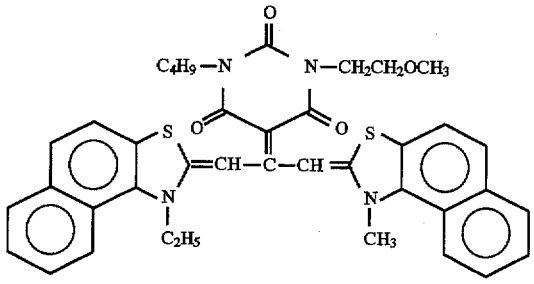
S-4
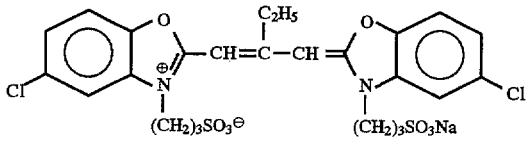
S-5
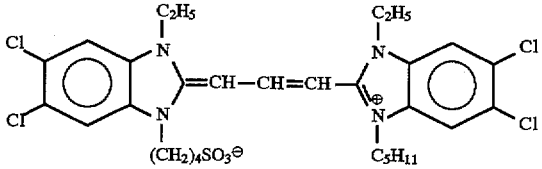
S-6
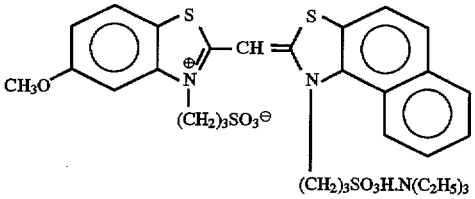
S-7
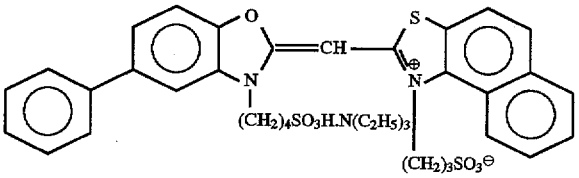
S-8
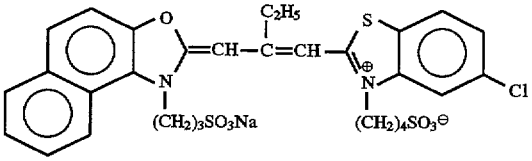
S-9
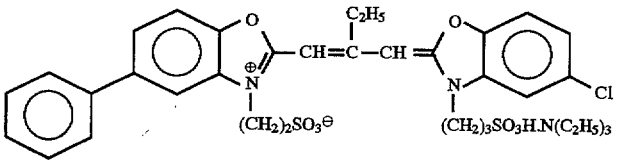
D-1
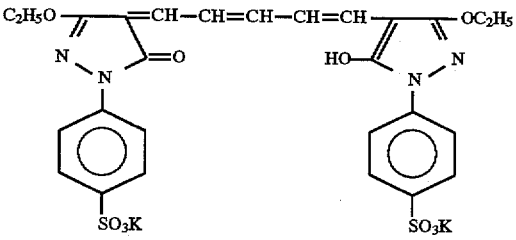

-continued
D-2
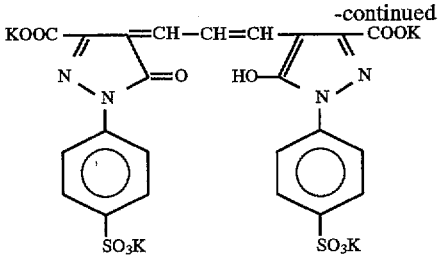
D-3
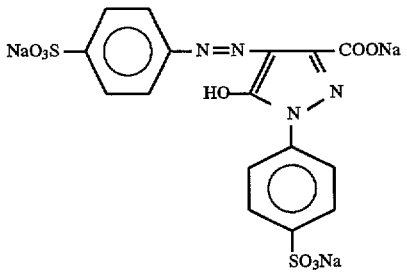
D-4
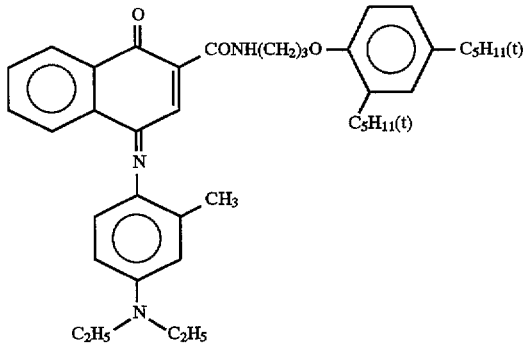
D-5
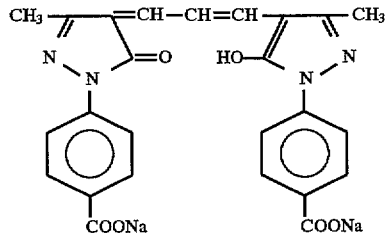
D-6
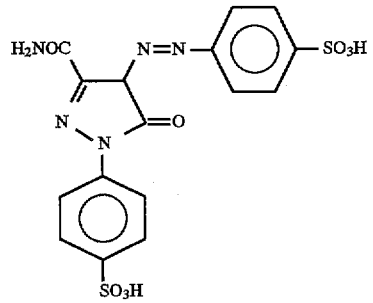
E-1
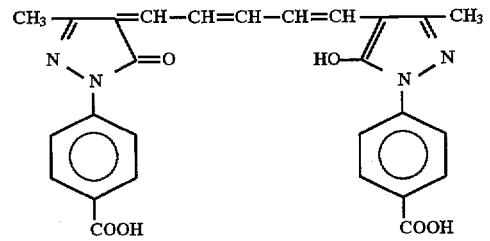

-continued
E-2
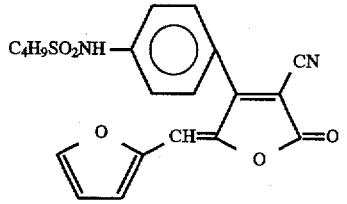
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
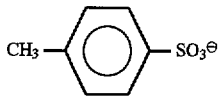
W-2
$C_8F_{17}SO_2CH(C_3H_7)CH_2COOK$
W-3
$NaO_3S{-}CH(CH_2COOCH_2CH(C_2H_5)C_4H_9)COOCH_2CH(C_2H_5)C_4H_9$
W-4
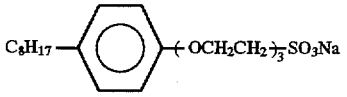
W-5
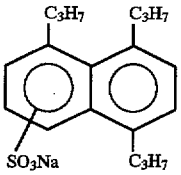
W-6
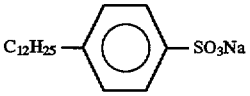
P-1
$\left(CH_2{-}CH(CONHC_4H_9(t))\right)_n$
M-1
$\left(CH_2{-}CH(COOC_4H_9)\right)_n$
F-1
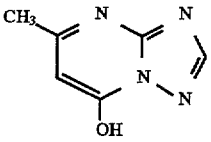
F-2
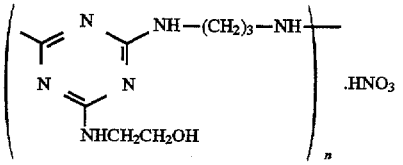
(n = 3 ~ 4)
F-3
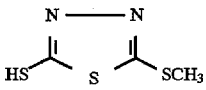

-continued

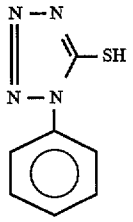

F-4

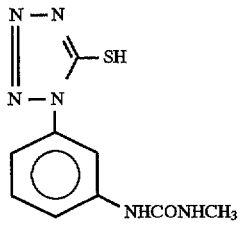

F-5

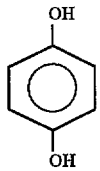

F-6

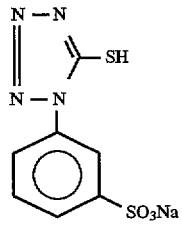

F-7

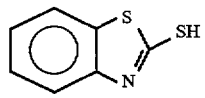

F-8

Samples 201A to 201D were prepared, changing the amount of gelatin applied to vary the film thickness in the same manner as with Example 1. The film thickness is shown in Table 7.

Changing the ammonium ion ratio in the same manner as with Example 1, running processing was conducted according to the following processing stages.

| Processing Stage | Time | Temperature (°C.) | Tank Capacity (liter) | Replenishment Rate (ml/m²) |
|---|---|---|---|---|
| First Development | 4 min | 38 | 12 | 1000 |
| First Washing | 45 sec | 38 | 2 | 2200 |
| Reversal | 45 sec | 38 | 2 | 500 |
| Color Development | 4 min | 38 | 12 | 1000 |
| Bleaching | 3 min | 38 | 4 | 200 |
| Fixing | 3 min | 38 | 8 | 500 |
| Second Washing (1) | 1 min | 38 | 2 | — |
| Second Washing (2) | 1 min | 38 | 2 | 1100 |
| Stabilizing | 1 min | 25 | 2 | 500 |
| Drying | 1 min | 65 | — | — |

wherein the replenishment of the second washing was carried out by a so-called countercurrent replenishing system in which a replenisher was introduced into the second washing (2) and an overflowed solution thereof was introduced into the second washing (1).

The composition of the respective processing solutions is as follows:

First Developing Solution

| | Tank Solution (g) | Replenisher (g) |
|---|---|---|
| Pentasodium Nitrilo-N,N,N-trimethylenephosphonate | 2.0 | 3.0 |
| Sodium Sulfite | 30 | 40 |
| Potassium Hydroquinonemonosulfonate | 30 | 40 |
| Potassium Carbonate | 40 | 48 |
| 1-Phenyl-4-methyl-4-hydroxymethyl-3-pyrazolidone | 2.0 | 3.5 |
| Potassium Bromide | 2.5 | 0 |
| Potassium Thiocyanate | 1.2 | 1.8 |
| Potassium Iodide | 2.0 mg | — |
| Water to make | 1000 ml | 1000 ml |
| pH | 10.00 | 10.20 |

The pH was adjusted with sulfuric acid or potassium hydroxide.

First Washing Solution

| | Tank Solution (g) | Replenisher (g) |
|---|---|---|
| Ethylenediaminetetramethylene-phosphonic Acid | 2.0 | the same as of tank solution |
| Disodium Phosphate | 5.0 | |
| Water to make | 1000 ml | |
| pH | 7.00 | |

The pH was adjusted with hydrochloric acid or sodium hydroxide.

Reversal Solution

| | Tank Solution (g) | Replenisher (g) |
|---|---|---|
| Pentasodium Nitrilo-N,N,N-trimethylenephosphonate | 3.0 | the same as of tank solution |
| Stannous Chloride.Dihydrate | 1.0 | |
| p-Aminophenol | 0.1 | |
| Sodium Hydroxide | 8 | |
| Glacial Acetic Acid | 15 ml | |
| Water to make | 1000 ml | |
| pH | 6.00 | |

The pH was adjusted with acetic acid or sodium hydroxide.

Color Developing Solution

| | Tank Solution (g) | Replenisher (g) |
|---|---|---|
| Pentasodium Nitrilo-N,N,N-trimethylenephosphonate | 2.0 | 3.0 |
| Sodium Sulfite | 7.0 | 10.0 |
| Trisodium Phosphate.Dodecahydrate | 40 | 45 |
| Potassium Bromide | 1.0 | — |
| Potassium Iodide | 90 mg | — |
| Sodium Hydroxide | 3.0 | 3.0 |
| Citrazinic Acid | 1.5 | 1.5 |
| N-Ethyl-N-(β-methanesulfonamido-ethyl)-3-methyl-4-aminoaniline. ½ Sulfuric Acid.Monohydrate | 15 | 20 |
| 3,6-Dithiaoctane-1.8-diol | 1.0 | 1.2 |
| Water to make | 1000 ml | 1000 ml |
| pH | 12.00 | 12.20 |

The pH was adjusted with sulfuric acid or potassium hydroxide.

Bleaching Solution

| | Tank Solution (g) | Replenisher (g) |
|---|---|---|
| Ammonium Ferric 1,3-Diaminopropane-tetraacetate.Monohydrate | 50 | 100 |
| Potassium Bromide | 100 | 200 |
| Ammonium Nitrate | 10 | 20 |
| Acetic Acid (90%) | 60 | 120 |
| 3-Mercapto-1,2,4-triazole | 0.0005 mol | 0.0008 mol |
| Water to make | 1000 ml | 1000 ml |

-continued

Bleaching Solution

| | Tank Solution (g) | Replenisher (g) |
|---|---|---|
| pH | 4.5 | 4.0 |

The pH was adjusted with and nitric acid or aqueous ammonia.

Fixing Solution

| | Tank Solution (g) | Replenisher (g) |
|---|---|---|
| Ethylenediaminetetraacetic Acid | 10.0 | 15.0 |
| Thioether Compound (FA-3) | Refer to Table 7 | |
| Ammonium Thiosulfate or Sodium Thiosulfate | 1.0 mol | 1.3 mol |
| Sodium Sulfite or Ammonium Sulfite | 0.20 mol | 0.24 mol |
| Water to make | 1000 ml | 1000 ml |
| pH | 6.60 | 6.80 |

The pH was adjusted with acetic acid or aqueous ammonia.

Second Washing Solution (both the tank solution and the replenisher)

Tap water was passed through a mix-bed-column charged with an H-type strongly acidic cation exchange resin (Amberlite IR-120B, manufactured by Rhom & Haas) and an OH-type strongly basic anion exchange resin (Amberlite IR-400, manufactured by Rhom & Haas) to reduce the concentration of calcium and magnesium ions to 3 mg/liter or less. Subsequently, 20 mg/liter of sodium dichloroisocyanurate and 1.5 g/liter of sodium sulfate were added thereto. The pH of the resulting solution was within the range of 6.5 to 7.5.

Stabilizing Solution

| | Tank Solution (g) | Replenisher (g) |
|---|---|---|
| 1-Hydroxymethyl-1,2,4-triazole | 2.3 | the same as of tank solution |
| Polyoxyethylene-p-monononyl Phenyl Ether (average degree of polymerization: 10) | 0.3 | |
| 1,2,4-Triazole | 2.0 | |
| 1,4-Bis(1,2,4-triazole-1-ylmethyl)-piperazine | 0.2 | |
| 1,2-Benzisothiazoline-3-one | 0.05 | |
| Water to make | 1000 ml | |
| pH | 6.5 | |

The pH was adjusted with sodium hydroxide or acetic acid.

The fixing performance test and the image keeping quality test were conducted in the same manner as with Example 1. Results are shown in Table 7.

TABLE 7

| Test No. | Sample No. | Film Thickness (μm) | Ammonium Ratio in Fixing Solution (mol %) | Concentration of Thioether Compound (mol/liter) | Amount of Residual Silver (μg/m²) | ΔDmin | Remarks |
|---|---|---|---|---|---|---|---|
| 2-1 | 201A | 25.1 | 100 | 0 | 2.8 | 0.06 | Comparison |
| 2-2 | 201B | 22.0 | 100 | 0 | 2.7 | 0.06 | Comparison |
| 2-3 | 201C | 16.9 | 100 | 0 | 2.6 | 0.06 | Comparison |
| 2-4 | 201D | 13.9 | 100 | 0 | 2.5 | 0.06 | Comparison |
| 2-5 | 201A | 25.1 | 100 | 0.01 | 2.8 | 0.06 | Comparison |
| 2-6 | 201B | 22.0 | 100 | 0.01 | 2.7 | 0.06 | Comparison |
| 2-7 | 201C | 16.9 | 100 | 0.01 | 2.6 | 0.06 | Comparison |
| 2-8 | 201D | 13.9 | 100 | 0.01 | 2.5 | 0.06 | Comparison |
| 2-9 | 201A | 25.1 | 50 | 0 | 6.1 | 0.14 | Comparison |
| 2-10 | 201B | 22.0 | 50 | 0 | 6.0 | 0.14 | Comparison |
| 2-11 | 201C | 16.9 | 50 | 0 | 5.9 | 0.14 | Comparison |
| 2-12 | 201D | 13.9 | 50 | 0 | 5.8 | 0.14 | Comparison |
| 2-13 | 201A | 25.1 | 50 | 0.01 | 6.0 | 0.14 | Comparison |
| 2-14 | 201B | 22.0 | 50 | 0.01 | 2.7 | 0.06 | Invention |
| 2-15 | 201C | 16.9 | 50 | 0.01 | 2.6 | 0.06 | Invention |
| 2-16 | 201D | 13.9 | 50 | 0.01 | 2.5 | 0.06 | Invention |
| 2-17 | 201A | 25.1 | 0 | 0 | 9.9 | 0.18 | Comparison |
| 2-18 | 201B | 22.0 | 0 | 0 | 9.8 | 0.18 | Comparison |
| 2-19 | 201C | 16.9 | 0 | 0 | 9.7 | 0.18 | Comparison |
| 2-20 | 201D | 13.9 | 0 | 0 | 9.6 | 0.18 | Comparison |
| 2-21 | 201A | 25.1 | 0 | 0.01 | 9.9 | 0.18 | Comparison |
| 2-22 | 201B | 22.0 | 0 | 0.01 | 3.4 | 0.09 | Invention |
| 2-23 | 201C | 16.9 | 0 | 0.01 | 3.1 | 0.09 | Invention |
| 2-24 | 201D | 13.9 | 0 | 0.01 | 2.8 | 0.08 | Invention |
| 2-25 | 201A | 25.1 | 0 | 0.001 | 9.9 | 0.17 | Comparison |
| 2-26 | 201B | 22.0 | 0 | 0.001 | 3.6 | 0.09 | Invention |
| 2-27 | 201C | 16.9 | 0 | 0.001 | 3.2 | 0.09 | Invention |
| 2-28 | 201D | 13.9 | 0 | 0.001 | 3.0 | 0.08 | Invention |

The results shown in Table 7 reveal that the photographic materials of the present invention are excellent in desilverization and prevention of increased stains.

EXAMPLE 3

Samples 201A and 202B of Example 2 were processed in the same manner as Example 2, except that the replenishment rate of the fixing solutions and the thioether compounds were changed as shown in Table 8. Results are shown in Table 8.

The results shown in Table 8 prove that the present invention is particularly effective when the replenishment rate is lowered.

EXAMPLE 4

A pH of the fixing solution (fixing tank solution) of test No. 2–23 in Example 2 was adjusted with hydrochloric acid to 4.5, 5.2, 6.0 and 6.7, and the resulting solutions were subjected to the yellow stain test in the same manner as with Example 2. As a result, the solutions showed 0.05, 0.06, 0.07

TABLE 8

| Test No. | Sample No. | Replenishment Rate in Fixing Solution (ml/m²) | Ammonium Ratio of Fixing Solution (mol %) | Thioether Compound Kind | Thioether Compound Concentration (mol/liter) | Amount of Residual Silver (μg/m²) | ΔDmin | Remarks |
|---|---|---|---|---|---|---|---|---|
| 3-1 | 201A | 1500 | 50 | — | — | 3.7 | 0.14 | Comparison |
| 3-2 | 201B | 1500 | 50 | — | — | 3.6 | 0.14 | Comparison |
| 3-3 | 201A | 1000 | 50 | — | — | 5.5 | 0.14 | Comparison |
| 3-4 | 201B | 1000 | 50 | — | — | 5.4 | 0.14 | Comparison |
| 3-5 | 201A | 500 | 50 | — | — | 6.1 | 0.14 | Comparison |
| 3-6 | 201B | 500 | 50 | — | — | 6.0 | 0.14 | Comparison |
| 3-7 | 201A | 1500 | 50 | FA-2 | 0.01 | 3.7 | 0.14 | Comparison |
| 3-8 | 201B | 1500 | 50 | FA-2 | 0.01 | 2.5 | 0.06 | Invention |
| 3-9 | 201A | 1500 | 50 | FA-10 | 0.01 | 3.7 | 0.14 | Comparison |
| 3-10 | 201B | 1500 | 50 | FA-10 | 0.01 | 2.5 | 0.06 | Invention |
| 3-11 | 201A | 1000 | 50 | FA-2 | 0.01 | 5.4 | 0.14 | Comparison |
| 3-12 | 201B | 1000 | 50 | FA-2 | 0.01 | 2.6 | 0.06 | Invention |
| 3-13 | 201A | 1000 | 50 | FA-10 | 0.01 | 5.4 | 0.14 | Comparison |
| 3-14 | 201B | 1000 | 50 | FA-10 | 0.01 | 2.6 | 0.06 | Invention |
| 3-15 | 201A | 500 | 50 | FA-2 | 0.01 | 6.0 | 0.14 | Comparison |
| 3-16 | 201B | 500 | 50 | FA-2 | 0.01 | 2.7 | 0.06 | Invention |
| 3-17 | 201A | 500 | 50 | FA-10 | 0.01 | 6.0 | 0.14 | Comparison |
| 3-18 | 201B | 500 | 50 | FA-10 | 0.01 | 2.7 | 0.06 | Invention |

and 0.09, respectively. The higher pH of the fixing solution resulted in lower ΔDmin, thus obtaining the excellent results.

EXAMPLE 5

Preparation of Samples 501A to 501C

Samples 501A to 501C were prepared in the same manner as Sample 201B of Example 2, except that yellow colloidal silver was removed from the yellow filter layer, the thirteenth layer, and dye dispersions SB-1 to SB-3 described below were added in place thereof so as to give a dye in an amount of 0.23 g/m$^2$.

Preparation of Sample 501D

Sample 501D was prepared in the same manner as Sample 501A, except that dye dispersion SB-4 described below was added in place of black colloidal silver contained in the first layer of Sample 501A so as to give a total dye amount of 0.26 g/m$^2$.

The additives to the above-described Samples 201B and 501A to 501D are shown in Table 9.

TABLE 9

| Sample No. | Additive to First Layer | Additive to Thirteenth Layer |
|---|---|---|
| 201B | Black Colloidal Silver | Yellow Colloidal Silver |
| 501A | Black Colloidal Silver | II-1 |
| 501B | Black Colloidal Silver | III-3 |
| 501C | Black Colloidal Silver | IV-6 |
| 501D | III-6/II-2 | II-1 |

Methods for preparing the dye dispersions used in the present invention are described below.

Preparation of Finely Divided Dye Dispersion SB-1

The dye was dispersed in a vibrating ball mill by the following method:

Water (21.7 ml), 3 ml of 5% aqueous solution of sodium p-octylphenoxyethoxyethanesulfonate and 0.5 g of 5% aqueous solution of p-octylphenoxypolyoxyethylene ether (polymerization degree: 10) were placed in a 700-ml ball mill, and 1.00 g of the dye of the present invention (II-1) and 500 ml of beads (diameter: 1 mm) of zirconium oxide were added thereto. The contents were dispersed for 2 hours. The vibrating ball mill used was a BO type ball mill manufactured by Chuo Kakoki.

The contents were taken out, and added to 8 g of a 12.5% aqueous solution of gelatin. The beads were filtered off to obtain a dye gelatin dispersion.

Dye dispersions SB-2 (dye III-3) and SB-3 (dye IV-6) were prepared in a similar manner.

Similarly, dye III-6 was mixed with dye II-2 in a weight ratio of 1:1 to prepare dye dispersion SB-4.

Samples 201B and 501A to 501D were processed in the same manner as with test No. 2-22 of Example 2, and the evaluation of yellow stains was conducted in the same manner as with Example 2.

Results are shown in Table 10.

TABLE 10

| Test No. | Sample No. | ΔDmin |
|---|---|---|
| 2-22 | 201B | 0.09 |
| 5-1 | 501A | 0.07 |
| 5-2 | 501B | 0.07 |
| 5-3 | 501C | 0.07 |
| 5-4 | 501D | 0.06 |

The results shown in Table 10 reveal that the use of the dye dispersions of the present invention further reduces yellow stains.

EXAMPLE 6

The evaluation of yellow stains was conducted in the same manner as Example 2, except that the stabilizing solution was changed to as described below in test No. 2-22 of Example 2.

Stabilizing Solution

| | Tank Solution/Replenisher (g) |
|---|---|
| p-Nonylphenoxy Polyglycidol (average polymerization degree of glycidol: 10) | 0.2 |
| Ethylenediaminetetraacetic Acid | 0.05 |
| 1,2,4-Triazole | 1.3 |
| 1,4-Bis(1,2,4-triazole-1-ylmethyl)-piperazine | 0.75 |
| Compound of Formula (FB) | Refer to Table 10 |
| Hydroxyethyl Cellulose (HEC SP-2000, Daicel Ltd.) | 0.1 |
| 1,2-Benzisothiazoline-3-one | 0.05 |
| Water to make | 1.0 liter |
| pH | 8.5 |

Results are shown in Table 11.

TABLE 11

Compound of General Formula (FB)

| Test No. | Kind | Amount Added (mol) | ΔDmin |
|---|---|---|---|
| 6-1 | — | — | 0.09 |
| 6-2 | FB-1 | $3 \times 10^{-4}$ | 0.07 |
| 6-3 | FB-2 | $3 \times 10^{-4}$ | 0.07 |
| 6-4 | FB-3 | $3 \times 10^{-4}$ | 0.07 |
| 6-5 | FB-1 | $1 \times 10^{-4}$ | 0.05 |
| 6-6 | FB-2 | $1 \times 10^{-4}$ | 0.05 |
| 6-7 | FB-3 | $1 \times 10^{-4}$ | 0.05 |

The results shown in Table 11 reveal that the use of the stabilizing solutions containing the compounds represented by general formula (FB) particularly reduces yellow stains.

According to the present invention, even when the concentration of ammonium ions contained in the processing solutions having bleaching ability is reduced, the desilverization performance can be improved in continuous processing and yellow stains can be prevented from increasing.

While the invention has been described in detail and with reference to specific embodiments thereof, it will be apparent to one skilled in the art that various changes and modifications can be made therein without departing from the spirits and scope thereof.

What is claimed is:

1. A method for processing a silver halide color photographic material comprising color developing the silver halide color photographic material having at least one silver halide emulsion layer on a support and having a hydrophilic colloidal layer containing at least one kind of dye as a finely divided solid grain dispersion after imagewise exposure, and desilverizing thereof, wherein said photographic material has a total dry film thickness of 8 to 22 μm, a concentration of ammonium ions contained in a processing solution having fixing ability used in desilverization is 0 to 50 mol % based on a total cations, said processing solution having fixing ability contains at least one kind of thioether compound, and said dye is a compound represented by formula II:

$$A_1{=}L_1{-}({-}L_2{=}L_3{-})_m{-}Q \qquad \text{(II)}$$

wherein $A_1$ represents an acidic nucleus, $L_1$, $L_2$, and $L_3$ each represents a methine group; Q represents an aryl group or a heterocyclic group; and m represents 0, 1, or 2, with the proviso that the compound represented by formula (II) has at least one group selected from the group consisting of (i) a carboxylic acid group, (ii) a sulfonamido group, (iii) an arylsulfamoyl group, (iv) a sulfonylcarbamoyl group, (v) a carbonylsulfamoyl group, (vi) an enol group of an oxonol dye and (vii) a phenolic hydroxyl group in one molecule, and has no other group having a water-solubility greater than the water solubility of groups (i)–(vii).

2. The method as claimed in claim 1, wherein a replenishment rate of the processing solution having fixing ability in continuously conducting said processing while replenishing the solution with a replenisher is 25 to 1000 ml/m$^2$ of photographic material.

3. The method as claimed in claim 1, wherein a pH of the processing solution having fixing ability is 4.5 to 6.5.

4. The method as claimed in claim 1, wherein said silver halide color photographic material is processed with a stabilizing solution containing a monobasic organic acid having at least one hydroxyl group after desilverization.

5. The method as claimed in claim 1, wherein the thioether compound contained in the processing solution having fixing ability is represented by formula (FA):

$$L_a—(A—L_b)_n—B—L_c \quad \text{(FA)}$$

wherein $L_a$ and $L_c$, which may be the same or different, each represents an alkyl group, an aryl group, an aralkyl group, an alkenyl group or a heterocyclic group; $L_a$ and $L_c$ may combine to each other to form a ring structure; $L_b$ represents an alkylene group, an arylene group, an aralkylene group or a heterocyclic linkage group; n represents 0 or an integer of 1 to 4; when n is an integer of 2 to 4, $(A—L_b)$ may be the same or different; A and B, which may be the same or different, each represents —S—, —O—, —N($R_a$)—, —C(=O)—, —C(=S)—, —S(=O)$_2$— or a combination thereof, with the proviso that at least one of A and B represents —S— ($R_a$ represents a hydrogen atom, an alkyl group, an aryl group, an aralkyl group or an alkenyl group).

6. The method as claimed in claim 5, wherein the thioether compound is contained in an amount of 0.0005 to 1.2 mol/l of processing solution.

7. The method as claimed in claim 1, wherein the concentration of ammonium ions in the processing solution is in an amount of 0 to 30 mol % based on a total cations.

8. The method as claimed in claim 7, wherein the concentration of aluminum ions in the processing solution is in an amount to 0 to 10 mol % based on a total cations.

9. The method as claimed in claim 8, wherein none of the aluminum ion contains in the processing solution.

10. The method as claimed in claim 1, wherein the processing solution comprises a stabilizing solution which contains a carboxylic acid represented by formula (FB);

$$HO—L—COOH \quad \text{(FB)}$$

wherein L represents a straight-chain or branched alykylene group having 1 to 5 carbon atoms.

11. The method as claimed in claim 10, wherein the carboxylic acid of formula (FB) is contained in an amount of 0.00001 to 0.5 mol/l of the stabilizing solution.

12. The method as claimed in claim 1, wherein the dye represented by formula is added in an amount of $5\times10^{-2}$ to $5\times10^{-7}$ mol/m$^2$ of the photographic material.

13. The method as claimed in claim 1, wherein a film of the photographic material has a thickness of 9 to 18 μm at 250° C., 55% RH.

14. The method as claimed in claim 13, wherein the film has a thickness of 10 to 14 μm.

* * * * *